US011250798B2

(12) United States Patent
Wang et al.

(10) Patent No.: US 11,250,798 B2
(45) Date of Patent: Feb. 15, 2022

(54) TIMING CONTROLLER, LIQUID CRYSTAL DISPLAY APPARATUS AND DISPLAY DRIVING METHOD

(71) Applicants: HEFEI BOE DISPLAY TECHNOLOGY CO., LTD., Anhui (CN); BOE TECHNOLOGY GROUP CO., LTD., Beijing (CN)

(72) Inventors: Jun Wang, Beijing (CN); Liugang Zhou, Beijing (CN); Jingang Liu, Beijing (CN); Ke Dai, Beijing (CN); Xiaofeng Yin, Beijing (CN); Jianwei Sun, Beijing (CN); Liu He, Beijing (CN); Zhenlin Qu, Beijing (CN); Qing Li, Beijing (CN); Yunyun Liang, Beijing (CN); Yulong Xiong, Beijing (CN); Yu Quan, Beijing (CN)

(73) Assignees: HEFEI BOE DISPLAY TECHNOLOGY CO., LTD., Hefei (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/994,217

(22) Filed: Aug. 14, 2020

(65) Prior Publication Data

US 2021/0049969 A1 Feb. 18, 2021

(30) Foreign Application Priority Data

Aug. 14, 2019 (CN) ..... 201910749823.7

(51) Int. Cl.
*G09G 3/36* (2006.01)
*G09G 3/34* (2006.01)

(52) U.S. Cl.
CPC ..... *G09G 3/3607* (2013.01); *G09G 3/3406* (2013.01); *G09G 3/3688* (2013.01); *G09G 2310/08* (2013.01)

(58) Field of Classification Search
CPC combination set(s) only.
See application file for complete search history.

(56) References Cited

U.S. PATENT DOCUMENTS 10,269,308 B2 * 4/2019 Yang ..... G09G 3/3406
2014/0320521 A1 10/2014 Oh et al.
(Continued)

FOREIGN PATENT DOCUMENTS

CN 104751818 A 7/2015
CN 105096875 A 11/2015
(Continued)

OTHER PUBLICATIONS

First Office Action for related CN Application No. 201910749823.7 dated Oct. 9, 2021; English translation of CN OA provided, 18 pages.

*Primary Examiner* — Van N Chow
(74) *Attorney, Agent, or Firm* — Procopio, Cory, Hargreaves & Savitch LLP

(57) ABSTRACT

A display driving method includes: determining, by a timing controller, an actual grayscale value of a sub-pixel image in an X-th row and a Y-th column according to a preset grayscale value of a sub-pixel image in an (X−1)-th row and the Y-th column and a preset grayscale value of the sub-pixel image in the X-th row and the Y-th column of an image frame to be displayed. The image frame to be displayed includes J rows and Q columns of sub-pixel images. X is greater than or equal to 2, and is less than or equal to J. Y is greater than or equal to 1, and is less than or equal to Q, and X, Y, J, and Q are all integers.

17 Claims, 11 Drawing Sheets

(56) References Cited

U.S. PATENT DOCUMENTS

| | | | | |
|---|---|---|---|---|
| 2016/0217593 | A1* | 7/2016 | Huang | G09G 3/207 |
| 2016/0293121 | A1 | 10/2016 | Zeng et al. | |
| 2017/0004797 | A1 | 1/2017 | Ban et al. | |
| 2017/0352317 | A1 | 12/2017 | Huang et al. | |
| 2018/0158434 | A1* | 6/2018 | Bian | G09G 5/06 |
| 2021/0035513 | A1 | 2/2021 | Cheng et al. | |
| 2021/0049966 | A1* | 2/2021 | Hsu | G09G 3/3258 |
| 2021/0049969 | A1* | 2/2021 | Wang | G09G 3/3688 |
| 2021/0225302 | A1* | 7/2021 | Huang | G09G 3/3607 |

FOREIGN PATENT DOCUMENTS

| | | | |
|---|---|---|---|
| CN | 105895040 | A | 8/2016 |
| CN | 107492359 | A | 12/2017 |
| CN | 109859713 | A | 6/2019 |
| CN | 110364126 | A | 10/2019 |
| EP | 2192572 | A2 | 2/2010 |
| KR | 1020140127664 | A | 11/2014 |
| KR | 1020170005238 | A | 1/2017 |

* cited by examiner

TIMING CONTROLLER, LIQUID CRYSTAL DISPLAY APPARATUS AND DISPLAY DRIVING METHOD

CROSS-REFERENCE TO RELATED APPLICATION

This application claims priority to Chinese Patent Application No. 201910749823.7, filed on Aug. 14, 2019, which is incorporated herein by reference in its entirety.

TECHNICAL FIELD

The present disclosure relates to the field of display technologies, and in particular, to a timing controller, a liquid crystal display apparatus and a display driving method.

BACKGROUND

Liquid crystal displays (LCDs) have been widely used in modern information devices, such as TVs, notebooks, computers, mobile phones, and personal digital assistants due to their small size, low power consumption, no radiation, and relatively low manufacturing cost.

SUMMARY

In one aspect, a display driving method is provided. The display driving method includes: determining, by a timing controller, an actual grayscale value of a sub-pixel image in an X-th row and a Y-th column according to a preset grayscale value of a sub-pixel image in an (X−1)-th row and the Y-th column and a preset grayscale value of the sub-pixel image in the X-th row and the Y-th column of an image frame to be displayed. Wherein, the image frame to be displayed includes J rows and Q columns of sub-pixel images, X is greater than or equal to 2, and is less than or equal to J, Y is greater than or equal to 1, and is less than or equal to Q, and X, Y, J, and Q are all integers.

In some embodiments, the display driving method further includes: updating, by the timing controller, the preset grayscale value of the sub-pixel image in the X-th row and the Y-th column of the image frame to be displayed to the actual grayscale value; and outputting, by the timing controller, actual grayscale values of all sub-pixel images of the image frame to be displayed to at least one source driver row by row, so that the at least one source driver drives J rows and Q columns of sub-pixels in a display panel row by row according to the actual grayscale values to display an image frame.

In some embodiments, determining the actual grayscale value of the sub-pixel image in the X-th row and the Y-th column according to the preset grayscale value of the sub-pixel image in the (X−1)-th row and the Y-th column and the preset grayscale value of the sub-pixel image in the X-th row and the Y-th column of the image frame to be displayed includes: receiving at least one overdrive look-up table, each overdrive look-up table including N rows and M columns of grayscale values, wherein, the N rows and M columns of grayscale values include first theoretical grayscale values located in a first row of the overdrive look-up table, second theoretical grayscale values located in a first column of the overdrive look-up table, and actual grayscale values located in remaining positions in the overdrive look-up table, each actual grayscale value corresponds to a first theoretical grayscale value and a second theoretical grayscale value; N and M are all integers greater than 1; and determining a position of a first theoretical grayscale value equal to the preset grayscale value of the sub-pixel image in the (X−1)-th row and the Y-th column in the overdrive look-up table and a position of a second theoretical grayscale value equal to the preset grayscale value of the sub-pixel image in the X-th row and the Y-th column in the overdrive look-up table; and determining the actual grayscale value of the sub-pixel image in the X-th row and the Y-th column from the overdrive look-up table according to the position of the first theoretical grayscale value and the position of the second theoretical grayscale value.

In some embodiments, the at least one overdrive look-up table includes a first overdrive look-up table and a second overdrive look-up table. The display driving method further includes: determining, by the timing controller, whether a pulse width modulation signal used to drive at least one light source in a backlight module to emit light is at a high level or a low level. Wherein, determining the position of the first theoretical grayscale value equal to the preset grayscale value of the sub-pixel image in the (X−1)-th row and the Y-th column in the overdrive look-up table and the position of the second theoretical grayscale value equal to the preset grayscale value of the sub-pixel image in the X-th row and the Y-th column in the overdrive look-up table, and determining the actual grayscale value of the sub-pixel image in the X-th row and the Y-th column from the overdrive look-up table according to the position of the first theoretical grayscale value and the position of the second theoretical grayscale value, includes: in response to determining that the pulse width modulation signal is at the high level: determining the position of the first theoretical grayscale value equal to the preset grayscale value of the sub-pixel image in the (X−1)-th row and the Y-th column in the first overdrive look-up table, and the position of the second theoretical grayscale value equal to the preset grayscale value of the sub-pixel image in the X-th row and the Y-th column in the first overdrive look-up table; determining the actual grayscale value of the sub-pixel image in the X-th row and the Y-th column from the first overdrive look-up table according to the position of the first theoretical grayscale value and the position of the second theoretical grayscale value in the first overdrive look-up table; and in response to determining that the pulse width modulation signal is at the low level: determining the position of the first theoretical grayscale value equal to the preset grayscale value of the sub-pixel image in the (X−1)-th row and the Y-th column in the second overdrive look-up table, and the position of the second theoretical grayscale value equal to the preset grayscale value of the sub-pixel image in the X-th row and the Y-th column in the second overdrive look-up table, and determining the actual grayscale value of the sub-pixel image in the X-th row and the Y-th column from the second overdrive look-up table according to the position of the first theoretical grayscale value and the position of the second theoretical grayscale value in the second overdrive look-up table.

In some embodiments, a grayscale value in a first row and a T-th column of the first overdrive look-up table is equal to a grayscale value in a first row and a T-th column of the second overdrive look-up table, T is greater than or equal to 2, and is less than or equal to M, and T is a integer; a grayscale value in a K-th row and a first column of the first overdrive look-up table is equal to a grayscale value in a K-th row and a first column of the second overdrive look-up table, K is greater than or equal to 2, and is less than or equal to N, and K is an integer; and an actual grayscale value in the K-th row and the T-th column of the first overdrive look-up table is greater than or equal to an actual grayscale value in the K-th row and the T-th column of the second overdrive look-up table, all actual grayscale values in the first overdrive look-up table are not completely equal, and all actual grayscale values in the second overdrive look-up table are not completely equal.

In some embodiments, the display driving method further includes: reading, by the timing controller, the first overdrive look-up table and the second overdrive look-up table from a non-volatile memory when a liquid crystal display apparatus is turned on; and storing, by the timing controller, the first overdrive look-up table and the second overdrive look-up table in a memory of the timing controller.

In some embodiments, after receiving the at least one overdrive look-up table, and before determining the actual grayscale value of the sub-pixel image in the X-th row and the Y-th column, the display driving method further includes: determining, by the timing controller, whether the preset grayscale value $L_{X-1}$ of the sub-pixel image in the (X−1)-th row and the Y-th column is equal to any first theoretical grayscale value in the first row of the overdrive look-up table, and determining, by the timing controller, whether the preset grayscale value $L_X$ of the sub-pixel image in the X-th row and the Y-th column is equal to any second theoretical grayscale value in the first column of the overdrive look-up table.

In some embodiments, determining the position of the first theoretical grayscale value equal to the preset grayscale value of the sub-pixel image in the (X−1)-th row and the Y-th column in the overdrive look-up table and the position of the second theoretical grayscale value equal to the preset grayscale value of the sub-pixel image in the X-th row and the Y-th column in the overdrive look-up table, and determining the actual grayscale value of the sub-pixel image in the X-th row and the Y-th column from the overdrive look-up table according to the position of the first theoretical grayscale value and the position of the second theoretical grayscale value, includes: in response to determining that the preset grayscale value $L_{X-1}$ of the sub-pixel image in the (X−1)-th row and the Y-th column is not equal to any first theoretical grayscale value, and the preset grayscale value $L_X$ of the sub-pixel image in the X-th row and the Y-th column is equal to a second theoretical grayscale value: selecting a third theoretical grayscale value B1 and a fourth theoretical grayscale value C1 nearest to $L_{X-1}$ from the first row of the overdrive look-up table, wherein $L_{X-1}$ is greater than B1, and is less than C1; determining a position of the third theoretical grayscale value B1 in the overdrive look-up table, a position of the fourth theoretical grayscale value C1 in the overdrive look-up table, and the position of the second theoretical grayscale value in the overdrive look-up table; determining a first adjustment grayscale value L1 of the sub-pixel image in the X-th row and the Y-th column from the overdrive look-up table according to the position of the third theoretical grayscale value B1 and the position of the second theoretical grayscale value, and a second adjustment grayscale value H1 of the sub-pixel image in the X-th row and the Y-th column from the overdrive look-up according to the position of the fourth theoretical grayscale value C1 and the position of the second theoretical grayscale value; and determining the actual grayscale value $L_{XY}$ of the sub-pixel image in the X-th row and the Y-th column according to a first formula or a second formula; wherein, the first formula is: $L_{XY}=L1+\lfloor(H1-L1)/(C1-B1)\rfloor\times(L_{X-1}-B1)$; and the second formula is: $L_{XY}=H1-\lfloor(H1-L1)/(C1-B1)\rfloor\times(C1-L_{X-1})$; where symbol $\lfloor\ \rfloor$ is a floor function.

In some embodiments, determining the position of the first theoretical grayscale value equal to the preset grayscale value of the sub-pixel image in the (X−1)-th row and the Y-th column in the overdrive look-up table and the position of the second theoretical grayscale value equal to the preset grayscale value of the sub-pixel image in the X-th row and the Y-th column in the overdrive look-up table, and determining the actual grayscale value of the sub-pixel image in the X-th row and the Y-th column from the overdrive look-up table according to the position of the first theoretical grayscale value and the position of the second theoretical grayscale value, includes: in response to determining that the preset grayscale value $L_X$ of the sub-pixel image in the X-th row and the Y-th column is not equal to any second theoretical grayscale value, and the preset grayscale value $L_{X-1}$ of the sub-pixel image in the (X−1)-th row and the Y-th column is equal to a first theoretical grayscale value: selecting a fifth theoretical grayscale value B2 and a sixth theoretical grayscale value C2 nearest to $L_X$ from the first column of the overdrive look-up table, wherein $L_X$ is greater than B2, and is less than C2; determining a position of the fifth theoretical grayscale value B2 in the overdrive look-up table, a position of the sixth theoretical grayscale value C2 in the overdrive look-up table, and the position of the first theoretical grayscale value in the overdrive look-up table; determining a third adjustment grayscale value L2 of the sub-pixel image in the X-th row and the Y-th column from the overdrive look-up table according to the position of the fifth theoretical grayscale value B2 and the position of the first theoretical grayscale value, and a fourth adjustment grayscale value H2 of the sub-pixel image in the X-th row and the Y-th column from the overdrive look-up table according to the position of the sixth theoretical grayscale value C2 and the position of the first theoretical grayscale value; and determining the actual grayscale value $L_{XY}$ of the sub-pixel image in the X-th row and the Y-th column according to a third formula or a fourth formula, wherein the third formula is: $L_{XY}=L2+\lfloor(H2-L2)/(C2-B2)\rfloor\times(L_X-B2)$; and the fourth formula is: $L_{XY}=H2-\lfloor(H2-L2)/(C2-B2)\rfloor\times(C2-L_X)$, wherein symbol $\lfloor\ \rfloor$ is a floor function.

In some embodiments, determining the position of the first theoretical grayscale value equal to the preset grayscale value of the sub-pixel image in the (X−1)-th row and the Y-th column in the overdrive look-up table and the position of the second theoretical grayscale value equal to the preset grayscale value of the sub-pixel image in the X-th row and the Y-th column in the overdrive look-up table, and determining the actual grayscale value of the sub-pixel image in the X-th row and the Y-th column from the overdrive look-up table according to the position of the first theoretical grayscale value and the position of the second theoretical grayscale value, includes: in response to determining that the preset grayscale value $L_{X-1}$ of the sub-pixel image in the (X−1)-th row and the Y-th column is not equal to any first theoretical grayscale value, and the preset grayscale value $L_X$ of the sub-pixel image in the X-th row and the Y-th column is not equal to any second theoretical grayscale value: selecting a third theoretical grayscale value B1 and a fourth theoretical grayscale value C1 nearest to $L_{X-1}$ from the first row of the overdrive look-up table, and selecting a fifth theoretical grayscale value B2 and a sixth theoretical grayscale value C2 nearest to $L_X$ from the first column of the overdrive look-up table, wherein $L_{X-1}$ is greater than B1, and is less than C1; and $L_X$ is greater than B2, and is less than C2; determining a position of the third theoretical grayscale value B1 in the overdrive look-up table, a position of the fourth theoretical grayscale value C1 in the overdrive look-up table, a position of the fifth theoretical grayscale value B2 in the overdrive look-up table, and a position of the sixth theoretical grayscale value C2 in the overdrive look-up table; from the overdrive look-up table, determining a fifth adjustment grayscale value L3 of the sub-pixel image in the X-th row and the Y-th column according to the position of the third theoretical grayscale value B1 and the position of the fifth theoretical grayscale value B2, a sixth adjustment grayscale value H3 of the sub-pixel image in the X-th row and the Y-th column according to the position of the fourth theoretical grayscale value C1 and the position of the fifth theoretical grayscale value B2, a seventh adjustment grayscale value L4 of the sub-pixel image in the X-th row and the Y-th column according to the position of the third theoretical grayscale value B1 and the position of the sixth theoretical grayscale value C2, and an eighth adjustment grayscale value H4 of the sub-pixel image in the X-th row and the Y-th column according to the position of the fourth theoretical grayscale value C1 and the position of the sixth theoretical grayscale value C2; and determining a first estimated grayscale value $L_{E1}$ of the sub-pixel image in the X-th row and the Y-th column according to a fifth formula or a sixth formula, wherein the fifth formula is: $L_{E1}=L3+\lfloor(H3-L3)/(C1-B1)\rfloor\times(L_{X-1}-B1)$; and the sixth formula is: $L_{E1}=H3-\lfloor(H3-L3)/(C1-B1)\rfloor\times(C1-L_{X-1})$; determining a second estimated grayscale value $L_{E2}$ of the sub-pixel image in the X-th row and the Y-th column according to a seventh formula or an eighth formula, wherein the seventh formula is: $L_{E2}=L4+\lfloor(H4-L4)/(C1-B1)\rfloor\times(L_{X-1}-B1)$; and the eighth formula is: $L_{E2}=H4-\lfloor(H4-L4)/(C1-B1)\rfloor\times(C1-L_{X-1})$; determining the actual grayscale value $L_{XY}$ of the sub-pixel image in the X-th row and the Y-th column according to a ninth formula or a tenth formula, and the first estimated grayscale value $L_{E1}$ and the second estimated grayscale value $L_{E2}$; wherein the ninth formula is: $L_{XY}=L_{E1}+\lfloor(L2-L_{E1})/(C2-B2)\rfloor\times(L_X-B2)$; and the tenth formula is: $L_{XY}=L_2-\lfloor(L_{E2}-L_{E1})/(C2-B2)\rfloor\times(C2-L_X)$, wherein symbol $\lfloor\ \rfloor$ is a floor function.

In another aspect, a timing controller is provided. The timing controller includes a memory and a controller. The memory is configured to store at least one overdrive look-up table, each overdrive look-up table including N rows and M columns of grayscale values, wherein the N rows and M columns of grayscale values include first theoretical grayscale values located in a first row of the overdrive look-up table, second theoretical grayscale values located in a first column of the overdrive look-up table, and actual grayscale values located in remaining positions in the overdrive look-up table; each actual grayscale value corresponds to a first theoretical grayscale value and a second theoretical grayscale value; N and M are all integers greater than 1. The controller is configured to retrieve an overdrive look-up table from the memory; and for an image frame to be displayed: determine a position of a first theoretical grayscale value equal to a preset grayscale value of a sub-pixel image in an (X−1)-th row and a Y-th column in the overdrive look-up table and a position of a second theoretical grayscale value equal to a preset grayscale value of a sub-pixel image in an X-th row and the Y-th column in the overdrive look-up table, and determine and output an actual grayscale value of the sub-pixel image in the X-th row and the Y-th column from the overdrive look-up table according to the position of the first theoretical grayscale value and the position of the second theoretical grayscale value, wherein the image frame to be displayed includes J rows and Q columns of sub-pixel images, X is greater than or equal to 2, and is less than or equal to J, Y is greater than or equal to 1, and is less than or equal to Q, and X, Y, J and Q are all integers.

In some embodiments, the at least one overdrive look-up table includes a first overdrive look-up table and a second overdrive look-up table. A grayscale value in a first row and a T-th column of the first overdrive look-up table is equal to a grayscale value in a first row and a T-th column of the second overdrive look-up table, and a grayscale value in a K-th row and a first column of the first overdrive look-up table is equal to a grayscale value in a K-th row and a first column of the second overdrive look-up table; and an actual grayscale value in the K-th row and the T-th column of the first overdrive look-up table is greater than or equal to an actual grayscale value in the K-th row and the T-th column of the second overdrive look-up table, all actual grayscale values in the first overdrive look-up table are not completely equal, and all actual grayscale values in the second overdrive look-up table are not completely equal; T is greater than or equal to 2, and is less than or equal to M; K is greater than or equal to 2, and is less than or equal to N, and T and K are both integers. The controller is configured to determine whether a pulse width modulation signal used to drive at least one light source in a backlight module to emit light is at a high level or a low level; in response to determining that the pulse width modulation signal is at the high level: retrieve the first overdrive look-up table from the memory; and for the image frame to be displayed: determine a position of a first theoretical grayscale value equal to the preset grayscale value of the sub-pixel image in the (X−1)-th row and the Y-th column in the first overdrive look-up table, and a position of a second theoretical grayscale value equal to the preset grayscale value of the sub-pixel image in the X-th row and the Y-th column in the first overdrive look-up table, and determine the actual grayscale value of the sub-pixel image in the X-th row and the Y-th column from the first overdrive look-up table according to the position of the first theoretical grayscale value and the position of the second theoretical grayscale value; and in response to determining that the pulse width modulation signal is at the low level: retrieve the second overdrive look-up table from the memory; and for the image frame to be displayed: determine a position of a first theoretical grayscale value equal to the preset grayscale value of the sub-pixel image in the (X−1)-th row and the Y-th column in the second overdrive look-up table, and a position of a second theoretical grayscale value equal to the preset grayscale value of the sub-pixel image in the X-th row and the Y-th column in the second overdrive look-up table, and determine the actual grayscale value of the sub-pixel image in the X-th row and the Y-th column from the second overdrive look-up table according to the position of the first theoretical grayscale value and the position of the second theoretical grayscale value.

In some embodiments, the controller is further configured to retrieve the first overdrive look-up table and the second overdrive look-up table from a non-volatile memory, and store them in the memory.

In some embodiments, the controller is further configured to receive the pulse width modulation signal and a clock signal. The controller is configured to, within each clock cycle of the clock signal, retrieve the first overdrive look-up table from the memory in response to determining that the pulse width modulation signal is at a high level, and retrieve the second overdrive look-up table from the memory in response to determining that the pulse width modulation signal is at a low level.

In some embodiments, in the first overdrive look-up table and the second overdrive look-up table: grayscale values from a second column to an M-th column in the first row increase in sequence, and grayscale values from a second row to an N-th row in the first column increase in sequence; a grayscale value in the second row and the first column is a minimum theoretical grayscale value, and actual grayscale values from the second column to the M-th column in the second row are all equal to the minimum theoretical grayscale value; a grayscale value in the N-th row and the first column is a maximum theoretical grayscale value, and actual grayscale values from the second column to the M-th column in the N-th row are all equal to the maximum theoretical grayscale value; and for a third row to an (N−1)-th row, actual grayscale values from the second column to the M-th column in each row change in a decreasing trend.

In some embodiments, in the first overdrive look-up table and the second overdrive look-up table: grayscale values from a second column to an M-th column in the first row increase in sequence, and grayscale values from a second row to an N-th row in the first column increase in sequence; a grayscale value in the second row and the first column is greater than a minimum theoretical grayscale value, and a grayscale value in the N-th row and the first column is less than a maximum theoretical grayscale value; and for the second row to the N-th row, actual grayscale values from the second column to the M-th column in each row change in a decreasing trend.

In another aspect, a liquid crystal display apparatus is provided. The liquid crystal display apparatus includes a liquid crystal display panel, a backlight module, and a drive system. The liquid crystal display panel includes a plurality of data lines. The backlight module includes a backlight driving circuit and at least one light source electrically connected to the backlight driving circuit. The backlight driving circuit is configured to drive the at least one light source according to a pulse width modulation signal. The drive system includes the above timing controller and at least one source driver. The timing controller is connected to the backlight driving circuit. The at least one source driver is connected to the timing controller and the plurality of data lines. The at least one source driver is configured to receive the actual grayscale value of the sub-pixel image in the X-th row and the Y-th column output by the timing controller, and provide a voltage signal to a corresponding data line according to the actual grayscale value.

In some embodiments, the liquid crystal display apparatus further includes a non-volatile memory. The non-volatile memory is configured to store the at least one overdrive look-up table.

In some embodiments, the liquid crystal display apparatus further comprises a circuit board and a first flexible printed circuit board that is connected to the circuit board and the liquid crystal display panel, wherein the at least one source driver is disposed on the liquid crystal display panel, and the timing controller and the non-volatile memory are disposed on the circuit board.

In some embodiments, the liquid crystal display apparatus further comprises a circuit board and a second flexible printed circuit board, wherein one edge of the second flexible printed circuit board is bonded to the liquid crystal display panel, and another edge of the second flexible printed circuit board is connected to the circuit board. The at least one source driver is disposed on the second flexible printed circuit board, and the timing controller and the non-volatile memory are disposed on the circuit board.

BRIEF DESCRIPTION OF THE DRAWINGS

In order to describe technical solutions in the present disclosure more clearly, accompanying drawings to be used in some embodiments of the present disclosure will be introduced below briefly. However, the accompanying drawings to be described below are merely accompanying drawings of some embodiments of the present disclosure, and a person of ordinary skill in the art may obtain other drawings according to these drawings. In addition, the accompanying drawings to be described below may be regarded as schematic diagrams, and are not limitations on actual sizes of products, an actual process of a method and actual timings of signals that the embodiments of the present disclosure relate to.

DETAILED DESCRIPTION

Figure 1:
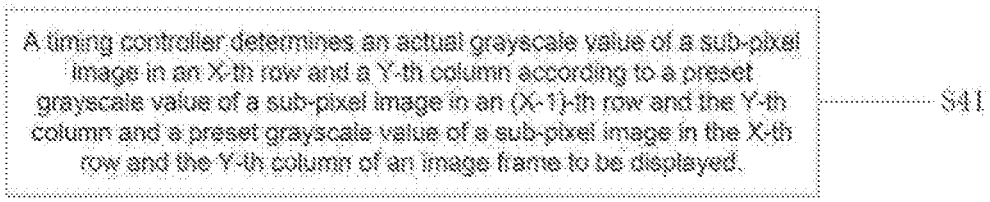
FIG. 1 is a flow diagram of a display driving method, in accordance with some embodiments.

The technical solutions in some embodiments of the present disclosure will be described clearly and completely with reference to the accompanying drawings. However, the described embodiments are merely some but not all embodiments of the present disclosure. All other embodiments obtained on a basis of the embodiments of the present disclosure by a person of ordinary skill in the art shall be included in the protection scope of the present disclosure.

Unless the context requires otherwise, the term "comprise" and other forms thereof, such as the third-person singular form "comprises" and the present participle form "comprising", in the description and the claims are construed as open and inclusive, i.e., "inclusive, but not limited to". In the description, terms such as "one embodiment", "some embodiments", "exemplary embodiments" "example", "specific example", or "some examples" are intended to indicate that specific features, structures, materials or characteristics related to the embodiment(s) or the example(s) are included in at least one embodiment or example of the present disclosure. Schematic representations of the above terms do not necessarily refer to the same embodiment(s) or example(s). In addition, the specific features, structures, materials or characteristics may be included in any one or more embodiments/examples in any suitable manner.

In addition, terms such as "first" and "second" are used for descriptive purposes only, and are not to be construed as indicating or implying the relative importance or implicitly indicating the number of indicated technical features below. Thus, features defined as "first" or "second" may explicitly or implicitly include one or more of the features. In the description of the embodiments of the present disclosure, terms "a plurality of" and "the plurality of" each mean two or more unless otherwise specified.

In the description of some embodiments, the terms such as "coupled" and "connected" and their extensions may be used. For example, the term "connected" may be used in the description of some embodiments to indicate that two or more components are in direct physical or electrical contact with each other. However, the terms such as "coupled" or "connected" may also mean that two or more components are not in direct contact with each other but still cooperate or interact with each other. The embodiments disclosed herein are not necessarily limited to the contents herein.

In the context, the use of "applied to" or "configured to" means an open and inclusive language, which does not exclude devices that are applied to or configured to perform additional tasks or steps.

In addition, the use of "based on" means an open and inclusive language, as the process, steps, calculation or other actions of being "based on" one or more of the said conditions or values may be based on additional conditions or exceeding the said values in practice.

In a driving process of a liquid crystal display panel, it takes a certain time for a driving voltage of a sub-pixel to rise to a preset value, so that an actual charging time of the sub-pixel is less than the preset charging time T. Therefore, the liquid crystal display panel has a problem of insufficient charging rate.

In the context, the sub-pixels in the liquid crystal display panel are in one-to-one correspondence with the sub-pixel images of the image frame to be displayed. That is, a driving voltage value corresponding to an actual grayscale value of each sub-pixel image is input to a corresponding sub-pixel in the liquid crystal display panel, so as to drive the sub-pixel to display the sub-pixel image.

As shown in FIG. 1, some embodiments of the present disclosure provide a display driving method. The method includes S41.

In S41, a timing controller determines an actual grayscale value of a sub-pixel image in an X-th row and a Y-th column according to a preset grayscale value of a sub-pixel image in an (X−1)-th row and the Y-th column and a preset grayscale value of a sub-pixel image in the X-th row and the Y-th column of an image frame to be displayed.

The image frame to be displayed includes J rows and Q columns of sub-pixel images. X is greater than or equal to 2 and is less than or equal to J. Y is greater than or equal to 1 and is less than or equal to Q. And X, Y, J, and Q are all integers.

It will be noted that the S41 may be performed for each image frame to be displayed. In addition, the preset grayscale value of the sub-pixel image in the (X−1)-th row and the Y-th column, the preset grayscale value of the sub-pixel image in the X-th row and the Y-th column, and the actual grayscale value of the sub-pixel image in the X-th row and the Y-th column may all be represented as digital signals. A person skilled in the art will understand that a digital signal characterizing a certain grayscale value corresponds to a driving voltage.

In addition, actual grayscale values of sub-pixel images in a first row of the image frame to be displayed are not determined, and preset grayscale values of sub-pixel images in the first row of the image frame to be displayed are directly used as the actual grayscale values.

In some embodiments, before the S41, the method further includes S40.

In S40, the timing controller obtains at least one image frame to be displayed.

For example, an image processor sends at least one image frame to be displayed to the timing controller, and the timing controller receives the at least one image frame to be displayed. For another example, the timing controller retrieves the at least one image frame to be displayed from, for example, a storage medium.

Figure 2:
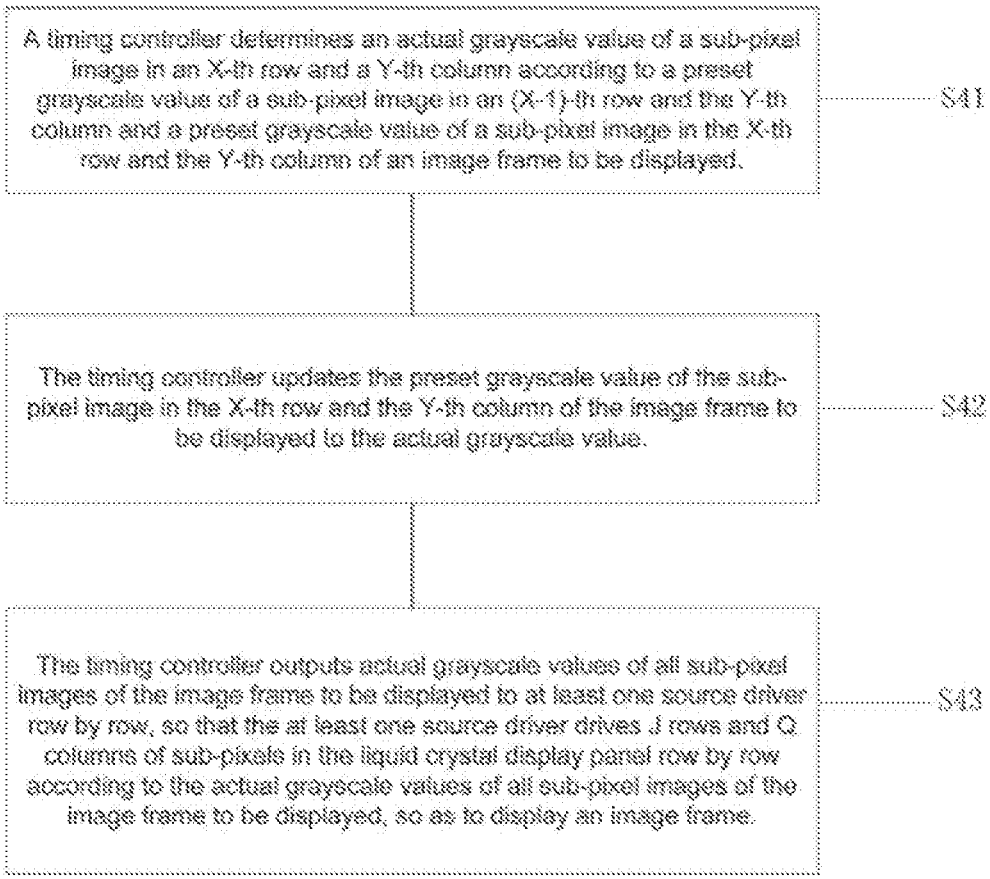
FIG. 2 is a flow diagram of another display driving method, in accordance with some embodiments.

In some embodiments, as shown in FIG. 2, after the S41, the method further includes steps S42 and S43.

In S42, the timing controller updates the preset grayscale value of the sub-pixel image in the X-th row and the Y-th column of the image frame to be displayed to the actual grayscale value.

Herein, the preset grayscale values of sub-pixel images in the first row of the image frame to be displayed are not updated, and are directly used as the actual grayscale values.

In S43, the timing controller outputs actual grayscale values of all sub-pixel images of the image frame to be displayed to at least one source driver row by row, so that the at least one source driver drives J rows and Q columns of sub-pixels in the liquid crystal display panel row by row according to the actual grayscale values of all sub-pixel images of the image frame to be displayed, so as to display an image frame.

The source driver can convert an actual grayscale value of each sub-pixel image of the image frame to be displayed into a corresponding driving voltage value, and outputs the driving voltage value to a corresponding sub-pixel in the liquid crystal display panel.

It will be noted that, the order of performing the S42 and the S43 may be as follows. For example, preset grayscale values of all sub-pixel images are updated to corresponding actual grayscale values firstly, which are then sequentially output to at least one source driver row by row. That is, the S42 is performed multiple times, and then the S43 is performed one time. Alternatively, preset grayscale values of a row of sub-pixel images are updated to corresponding actual grayscale values, which are then output to the at least one source driver, and S42 and S43 are repeated in the order of rows. In this case, the S42 for one row and the S43 for another row may be performed simultaneously. For example, the S42 for updating the preset grayscale values of sub-pixel images in the X-th row and the S43 for outputting the actual grayscale values of sub-pixel images in the (X−1)-th row may be performed simultaneously.

During the image display of the liquid crystal display panel, sub-pixels of a previous row (the (X−1)-th row) are driven before sub-pixels of a current row (the X-th row) are driven. When the sub-pixel in the X-th row and the Y-th column is driven, if the grayscale value of the sub-pixel image in the X-th row and the Y-th column is different from the grayscale value of the sub-pixel image in the (X−1)-th row and the Y-th column, the driving voltage of the sub-pixel in the (X−1)-th row and the Y-th column is different from the driving voltage of the sub-pixel in the X-th row and the Y-th column. That is, there is a jump between these two driving voltages.

In this case, the greater an absolute value of a voltage difference between these two driving voltages is, the faster a deflection speed of the liquid crystal molecules of the sub-pixel in the X-th row and the Y-th column is, the shorter the time required for the driving voltage of this sub-pixel to rise to the preset value is, and the longer the charging time of this sub-pixel is. In this way, if the actual grayscale value of the sub-pixel image in the X-th row and the Y-th column is determined according to the preset grayscale value of the sub-pixel image in the (X−1)-th row and the Y-th column and the preset grayscale value of the sub-pixel image in the X-th row and the Y-th column, the voltage difference between the driving voltages corresponding to actual grayscale values of the two sub-pixel images may be made larger. Therefore, it may be ensured that the sub-pixel in the X-th row and the Y-th column has a sufficient charging time.

Figure 3A:
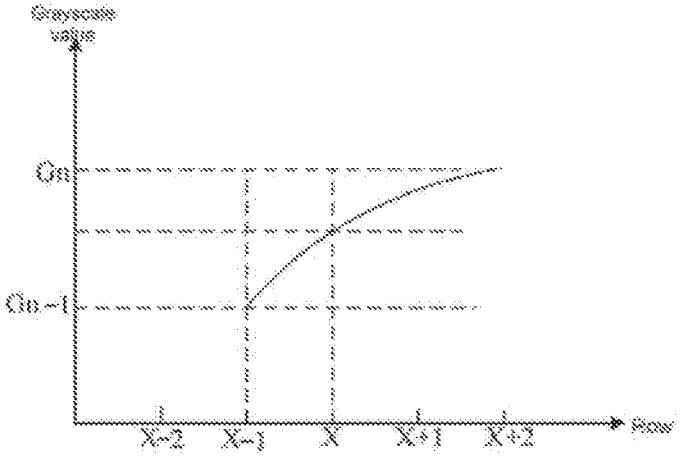
FIG. 3A is a drive principle diagram of a sub-pixel image in an X-th row and a Y-th column in the related art.

For example, as shown in FIG. 3A, the preset grayscale value of the sub-pixel image in the X-th row and the Y-th column is Gn, and the preset grayscale value of the sub-pixel image in the (X−1)-th row and the Y-th column is (Gn−1). In a case where a first driving voltage value corresponding to the preset grayscale value Gn is input to the sub-pixel in the X-th row and the Y-th column, if an absolute value of a voltage difference between the first driving voltage value corresponding to the preset grayscale value Gn and a second driving voltage value corresponding to the preset grayscale value (Gn−1) is small, a grayscale value displayed on this sub-pixel may not reach the expected preset grayscale value Gn within the charging time.

Figure 3B:
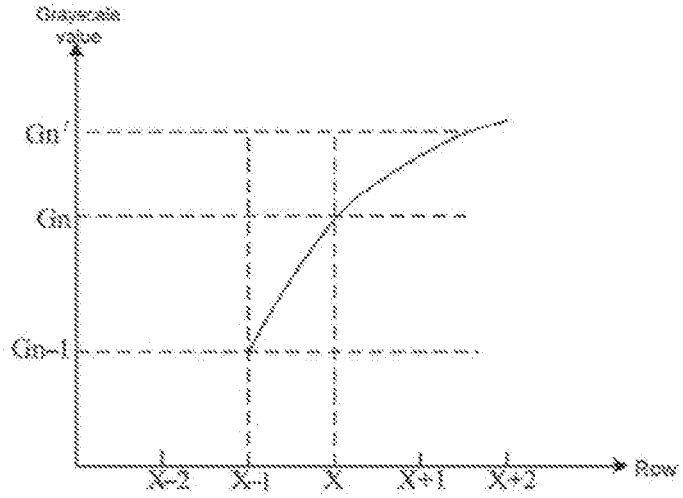
FIG. 3B is a drive principle diagram of a sub-pixel image in an X-th row and a Y-th column, in accordance with some embodiments.

However, as shown in FIG. 3B, if a third driving voltage value corresponding to a grayscale value Gn' (wherein Gn' is greater than Gn) is provided to the sub-pixel in the X-th row and the Y-th column, and an absolute value of the voltage difference between the third driving voltage value corresponding to the grayscale value Gn' and the second driving voltage value is greater than the absolute value of the voltage difference between the first driving voltage value and the second driving voltage value, the rising speed of the driving voltage of the sub-pixel in the X-th row and the Y-th column may be accelerated, and a rising time of the driving voltage may be reduced. Therefore, the charging rate of the sub-pixel may be improved, so that the grayscale value displayed on the sub-pixel in the X-th row and the Y-th column may reach the expected preset grayscale value Gn within the charging time.

After the charging time of the sub-pixel in the X-th row and the Y-th column is over, the preset grayscale value Gn of the sub-pixel in the X-th row and the Y-th column will be maintained for a period of time within an allowable error range.

In some embodiments, the liquid crystal display apparatus includes the liquid crystal display panel and a backlight module for providing light for the liquid crystal display panel. The backlight module includes at least one backlight, and the at least one backlight may emit light under the control of a pulse width modulation (PWM) signal.

According to the PWM signal, the light emitted by the backlight module (i.e., the light incident on the liquid crystal display panel) alternately changes between brightness and darkness at a certain frequency. That is, the PWM signal can vary from a high voltage level to a low voltage level. When the PWM signal is at a low level, the backlight is off, and the backlight module does not emit light. When the PWM signal is at a high level, the backlight is on, and the backlight module emits light.

Figure 6:
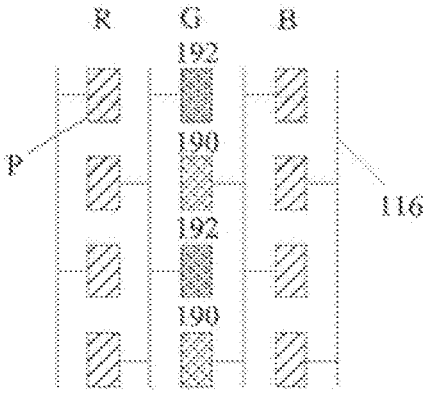
FIG. 6 is a schematic diagram of grayscale values corresponding to sub-pixels when the water fall defect arises.

As shown in FIG. 6, the liquid crystal display panel includes a plurality of sub-pixels P and a plurality of data lines 116. The plurality of sub-pixels P may include a plurality of red sub-pixels R, a plurality of green sub-pixels G, and a plurality of blue sub-pixels B, and colors of sub-pixels in each column may be the same. The sub-pixel P includes at least one thin film transistor (TFT). The TFT includes an active layer. When the light emitted from the backlight module reaches the active layer, the characteristics of the carriers in the active layer may be affected. That is, the characteristics of the carriers in the active layer are different when it is illuminated and not illuminated.

Figure 4:
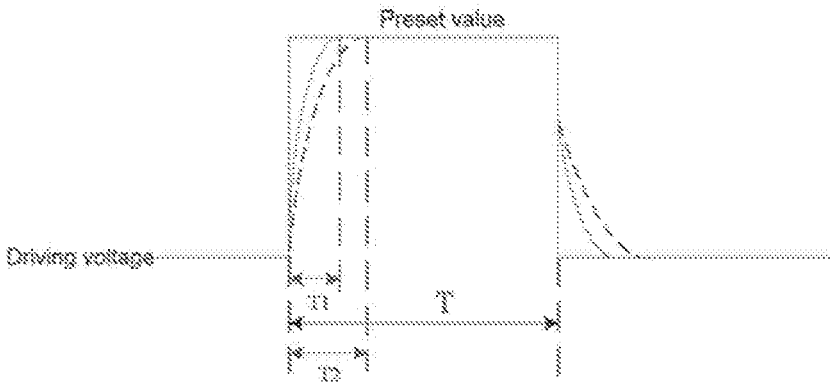
FIG. 4 is a schematic diagram showing time required for a driving voltage of a sub-pixel to rise to a preset value when a backlight is on and off, in accordance with some embodiments.

For example, as shown in FIG. 4, a preset charging time of the sub-pixel is T. Time required for the driving voltage of the sub-pixel to rise to a preset value is T1 under no illumination, and the actual charging time of the sub-pixel is (T−T1). Time required for the driving voltage of the sub-pixel to rise to the preset value is T2 under illumination, and the actual charging time of the sub-pixel is (T−T2). Since the impedance of the active layer under illumination is larger than the impedance of the active layer under no illumination, the driving voltage rises slower under illumination, and T2 is greater than T1. Therefore, the actual charging time (T−T2) of the sub-pixel under illumination may be less than the actual charging time (T−T1) of the sub-pixel under no illumination.

For example, as shown in FIG. 6, when the liquid crystal display panel displays a green monochromatic image, the preset grayscale values of all red sub-pixels R and blue sub-pixels B are 0, and the preset grayscale values of all green sub-pixels G are 192. It is assumed that a charging rate of the green sub-pixels G in the second row and fourth row is less than a charging rate of the green sub-pixels G in the first row and third rows. In this case, the grayscale values of the green sub-pixels G in the second row and fourth row may be 190, and the grayscale values of the green sub-pixels G in the first row and third row may be 192. Therefore, the display brightness of the green sub-pixels G in the second row and fourth row may be lower than the display brightness of the green sub-pixels G in the first row and third row, resulting in a water fall defect on the entire liquid crystal display panel shown in FIG. 5.

Figure 7:
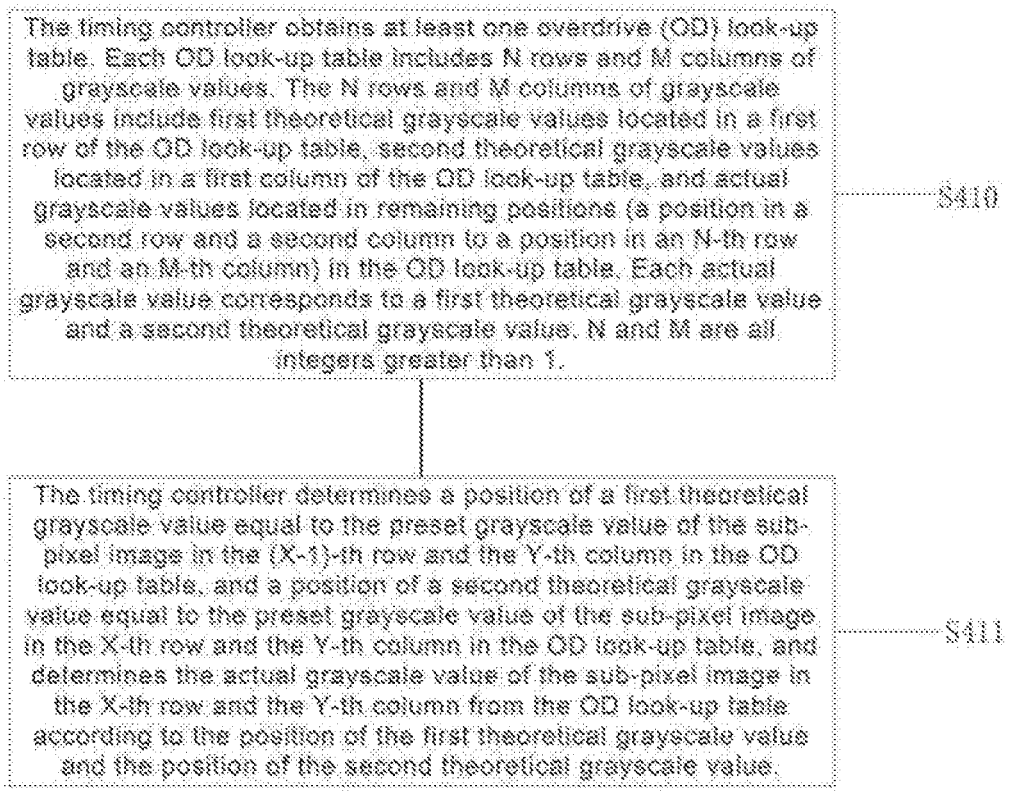
FIG. 7 is a flow diagram of the S41 in the display driving method shown in FIG. 2, in accordance with some embodiments.

With regard to the above defect, in some embodiments, as shown in FIG. 7, the S41, in which the timing controller determines the actual grayscale value of the sub-pixel image in the X-th row and the Y-th column according to the preset grayscale value of the sub-pixel image in the (X−1)-th row and the Y-th column and the preset grayscale value of the sub-pixel image in the X-th row and the Y-th column of the image frame to be displayed, includes S410 and S411.

In S410, the timing controller obtains at least one overdrive (OD) look-up table. Each OD look-up table includes N rows and M columns of grayscale values. The N rows and M columns of grayscale values include first theoretical grayscale values located in a first row of the OD look-up table, second theoretical grayscale values located in a first column of the OD look-up table, and actual grayscale values located in remaining positions (a position in a second row and a second column to a position in an N-th row and an M-th column) in the OD look-up table. Each actual grayscale value corresponds to a first theoretical grayscale value and a second theoretical grayscale value. N and M are all integers greater than 1.

For example, the timing controller receives the at least one OD look-up table from the image processor. Alternatively, the timing controller retrieves the at least one OD look-up table from a storage medium.

Figure 5:
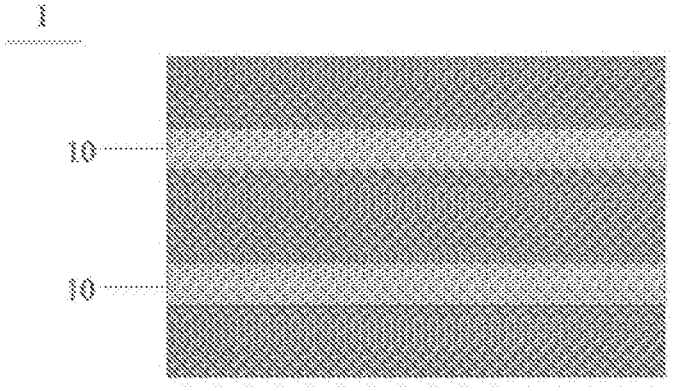
FIG. 5 is a schematic diagram of a water fall defect in a liquid crystal display panel.

The actual grayscale values in the OD look-up table may be obtained by experimental means. Since the grayscale values displayed on the sub-pixels in the liquid crystal display panel depends on the driving voltages applied to the sub-pixels, by adjusting the driving voltages applied to the sub-pixels, the grayscale values displayed on the sub-pixels may be different. For example, as shown in FIGS. 5 and 6, when the liquid crystal display panel displays a monochromatic image, if the driving voltages corresponding to preset grayscale values of sub-pixel images of the image frame to be displayed are applied to corresponding sub-pixels in the liquid crystal display panel, the grayscale values actually displayed on the sub-pixels in different rows of the liquid crystal display panel may be different. In this case, by adjusting the driving voltages applied to the sub-pixels, the grayscale values actually displayed on the sub-pixels in different rows of the liquid crystal display panel are basically the same. The grayscale values corresponding to the adjusted driving voltages may be used as the actual grayscale values of these sub-pixel images in the OD look-up table.

In addition, grayscale values corresponding to the adjusted driving voltages may be measured multiple times. For each sub-pixel image, the grayscale values measured are averaged to obtain the actual grayscale value of the sub-pixel image. Of course, the actual grayscale value may be obtained in other ways.

In S411, the timing controller determines a position of a first theoretical grayscale value equal to the preset grayscale value of the sub-pixel image in the (X−1)-th row and the Y-th column in the OD look-up table, and a position of a second theoretical grayscale value equal to the preset grayscale value of the sub-pixel image in the X-th row and the Y-th column in the OD look-up table, and determines the actual grayscale value of the sub-pixel image in the X-th row and the Y-th column from the OD look-up table according to the position of the first theoretical grayscale value and the position of the second theoretical grayscale value.

For example, the OD look-up table with N rows and M columns is an N by M table. The N by M is, for example, 8 by 8, 10 by 10, 20 by 20, 34 by 34, or 20 by 34. The values of N and M may not be equal.

For example, as shown in Table 1, N and M are both 8. For the sub-pixel image in the X-th row and the Y-th column of the image frame to be displayed, if the preset grayscale value of the sub-pixel image in the (X−1)-th row and the Y-th column is 48, the first theoretical grayscale value equal to 48 is in the third column. If the grayscale value of the sub-pixel image in the X-th row and the Y-th column is 96, the second theoretical grayscale value equal to 96 is in the fourth row. Then, the actual grayscale value of the sub-pixel image in the X-th row and the Y-th column is determined to be 116 that is in the fourth row and the third column of the OD look-up table. When the sub-pixel in the X-th row and the Y-th column of the liquid crystal display panel is driven, a driving voltage corresponding to the actual grayscale value 116 is applied to this sub-pixel.

TABLE 1

| OD look-up table | 0 | 48 | 96 | 144 | 192 | 240 | 255 |
|---|---|---|---|---|---|---|---|
| 0 | 0 | 0 | 0 | 0 | 0 | 0 | 0 |
| 48 | 81 | 48 | 26 | 16 | 12 | 8 | 7 |
| 96 | 129 | 116 | 96 | 78 | 68 | 52 | 50 |
| 144 | 174 | 174 | 158 | 144 | 128 | 114 | 114 |
| 192 | 214 | 220 | 212 | 204 | 192 | 182 | 182 |
| 240 | 254 | 254 | 252 | 248 | 246 | 240 | 240 |
| 255 | 255 | 255 | 255 | 255 | 255 | 255 | 255 |

In some embodiments, the at least one OD look-up table includes a first OD look-up table and a second OD look-up table.

The backlight may include at least one light source. In this case, the display driving method further includes: determining, by the timing controller, whether a pulse width modulation signal used to drive the at least one light source in the backlight module to emit light is at a high level or a low level.

In some examples, a first voltage threshold and a second voltage threshold are set in advance. The PWM signal is determined to be at a high level when it is detected that the voltage value of the PWM signal is greater than the first voltage threshold. And the PWM signal is determined to be at a low level when the voltage value of the PWM signal is detected to be less than the second voltage threshold. For examples, the above process may be implemented by a circuit, such as a comparator.

Figure 8:
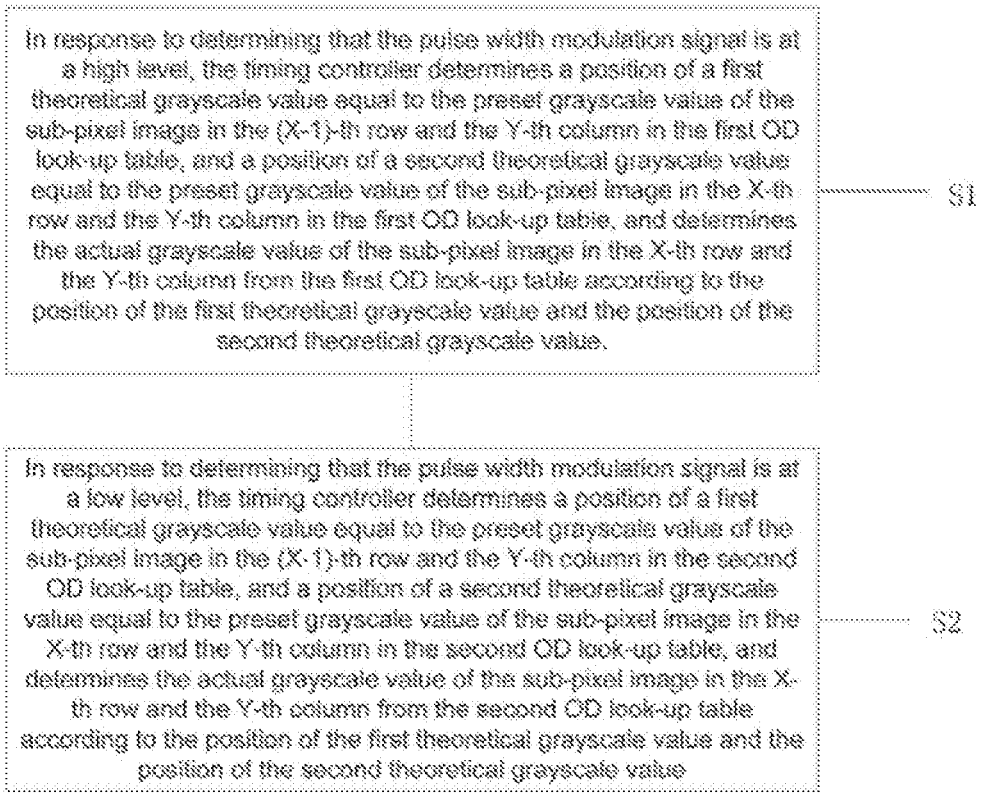
FIG. 8 is a flow diagram of the S411 in the display driving method shown in FIG. 7, in accordance with some embodiments.

On this basis, the S411, in which the timing controller determines a position of a first theoretical grayscale value equal to the preset grayscale value of the sub-pixel image in the (X−1)-th row and the Y-th column in the OD look-up table, and a position of a second theoretical grayscale value equal to the preset grayscale value of the sub-pixel image in the X-th row and the Y-th column in the OD look-up table, and determines the actual grayscale value of the sub-pixel image in the X-th row and the Y-th column from the OD look-up table according to the position of the first theoretical grayscale value and the position of the second theoretical grayscale value, as shown in FIG. 8, includes S1 and S2.

In S1, in response to determining that the pulse width modulation signal is at a high level, the timing controller determines a position of a first theoretical grayscale value equal to the preset grayscale value of the sub-pixel image in the (X−1)-th row and the Y-th column in the first OD look-up table, and a position of a second theoretical grayscale value equal to the preset grayscale value of the sub-pixel image in the X-th row and the Y-th column in the first OD look-up table, and determines the actual grayscale value of the sub-pixel image in the X-th row and the Y-th column from the first OD look-up table according to the position of the first theoretical grayscale value and the position of the second theoretical grayscale value.

In S2, in response to determining that the pulse width modulation signal is at a low level, the timing controller determines a position of a first theoretical grayscale value equal to the preset grayscale value of the sub-pixel image in the (X−1)-th row and the Y-th column in the second OD look-up table, and a position of a second theoretical grayscale value equal to the preset grayscale value of the sub-pixel image in the X-th row and the Y-th column in the second OD look-up table, and determines the actual grayscale value of the sub-pixel image in the X-th row and the Y-th column from the second OD look-up table according to the position of the first theoretical grayscale value and the position of the second theoretical grayscale value.

In these embodiments, the first OD look-up table is provided to be used when the backlight is on, and the second OD look-up table is provided to be used when the backlight is off. In this way, it may be ensured that the time taken for the driving voltage of the sub-pixel to rise to the preset value is approximately equal in the presence and absence of light, and the charging time of the sub-pixel may be approximately equal when the backlight is on and off. Therefore, the impact of light on the charging time of the sub-pixel may be reduced, a high charging rate of the liquid crystal display panel may be further ensured, and the phenomenon of water fall defect may be improved.

In some examples, both the first OD look-up table and the second OD look-up table include N rows and M columns of grayscale values. A grayscale value in a first row and a T-th column of the first OD look-up table is equal to a grayscale value in a first row and a T-th column of the second OD look-up table, and a grayscale value in a K-th row and a first column of the first OD look-up table is equal to a grayscale value in a K-th row and a first column of the second OD look-up table. An actual grayscale value in the K-th row and the T-th column of the first OD look-up table is greater than or equal to an actual grayscale value in the K-th row and the T-th column of the second OD look-up table. All actual grayscale values in the first OD look-up table are not completely equal, and all actual grayscale values in the second OD look-up table are not completely equal. T is greater than or equal to 2, and is less than or equal to M. K is greater than or equal to 2, and is less than or equal to N. And T and K are both integers.

Figure 9:
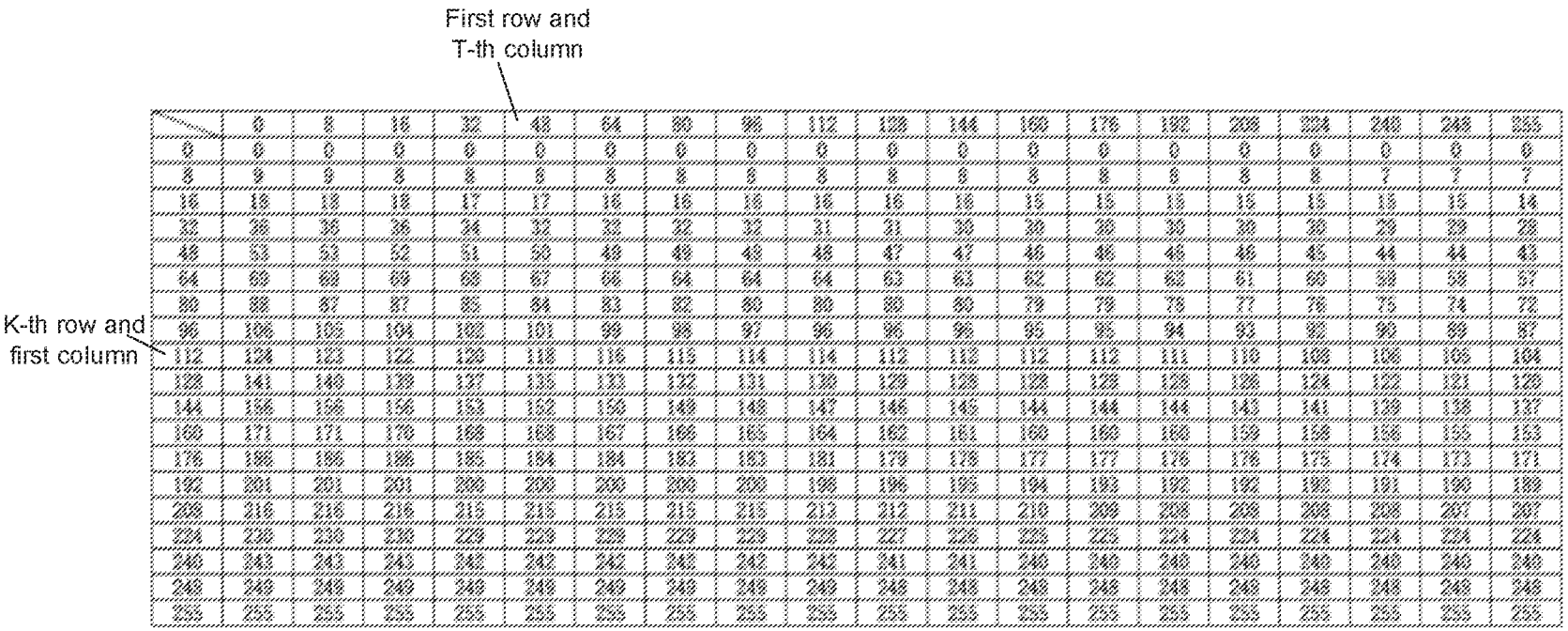
FIG. 9 is a schematic diagram of a first overdrive (OD) look-up table, in accordance with some embodiments.
Figure 10:
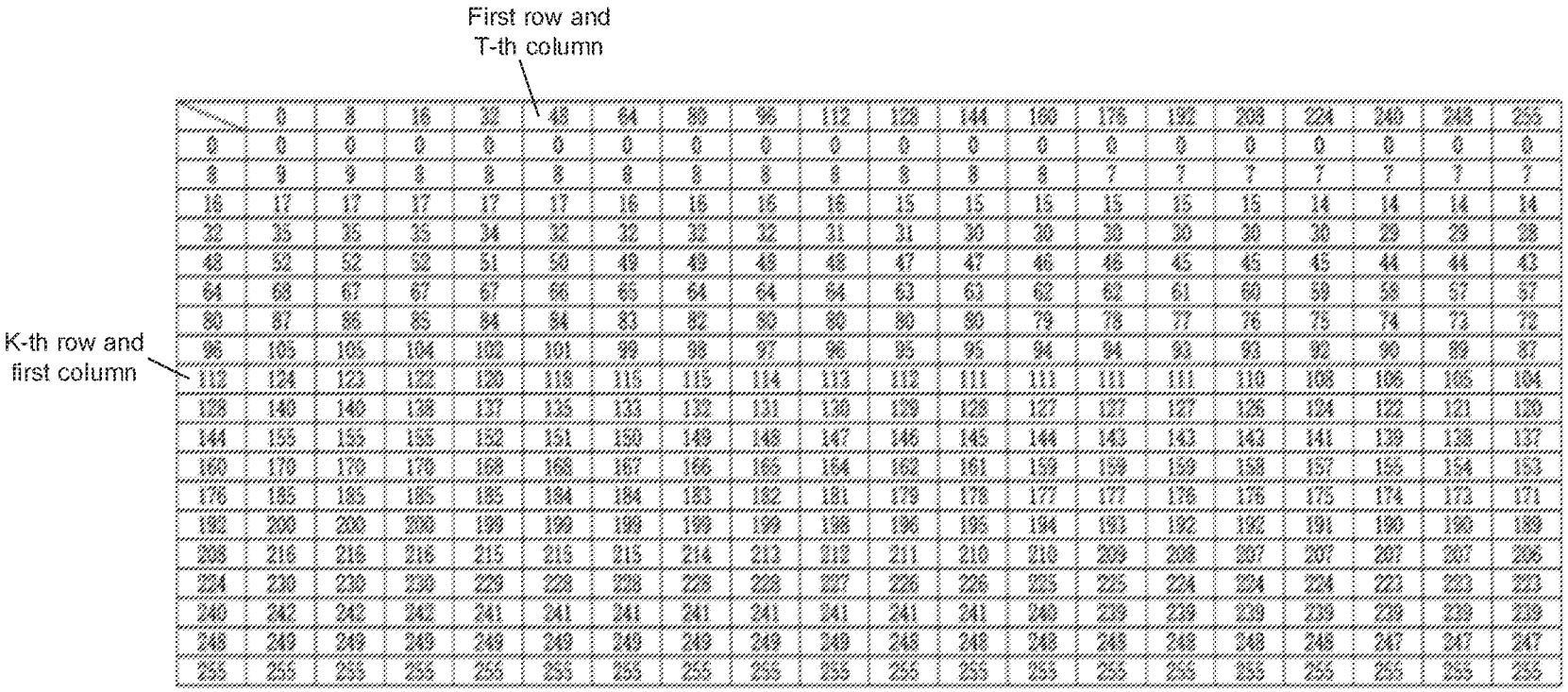
FIG. 10 is a schematic diagram of a second overdrive (OD) look-up table, in accordance with some embodiments.

In an example where N by M is 20 by 20, as shown in FIGS. 9 and 10, the grayscale values from the second column to the twentieth column in the first row of the first OD look-up table are 0, 8, 16, 32, 48, 64, 80, 96, 112, 128, 144, 160, 176, 192, 208, 224, 240, 248, and 255 in sequence. Correspondingly, the grayscale values from the second column to the twentieth column in the first row of the second OD look-up table are 0, 8, 16, 32, 48, 64, 80, 96, 112, 128, 144, 160, 176, 192, 208, 224, 240, 248, and 255 in sequence. The grayscale values from the second row to the twentieth row in the first column of the first OD look-up table are 0, 8, 16, 32, 48, 64, 80, 96, 112, 128, 144, 160, 176, 192, 208, 224, 240, 248, and 255 in sequence. Correspondingly, the grayscale values from the second row to the twentieth row in the first column of the second OD look-up table are 0, 8, 16, 32, 48, 64, 80, 96, 112, 128, 144, 160, 176, 192, 208, 224, 240, 248, and 255 in sequence. It will be noted that, the data in FIGS. 9 and 10 are exemplary data.

Since the actual grayscale value of the sub-pixel image in the K-th row and the T-th column in the first OD look-up table is greater than or equal to the actual grayscale value of the sub-pixel image in the K-th row and the T-th column in the second OD look-up table, the driving voltage of this sub-pixel may be made to rise to the preset value quickly when the backlight is on. In this case, the rising time of the driving voltage when the backlight is on may be reduced, and the impact of light on the rising time of the driving voltage of the sub-pixel may be lowered. In this way, it may be ensured that the time for the driving voltage to rise to the preset value when the backlight is on is approximately equal to the time for the driving voltage to rise to the preset value when the backlight is off, so that the charging rates of the sub-pixel may be approximately equal when the backlight is on and off, thereby improving the insufficient charging rate of the liquid crystal display apparatus and the water fall defect, and enhancing the display brightness of the liquid crystal display apparatus.

It will be noted that with regard to the method of obtaining the first and second OD look-up tables, reference may be made to the descriptions of the OD look-up table, and the difference is in that the first and second OD look-up tables are obtained when the backlight is on and off, respectively.

Figure 19:
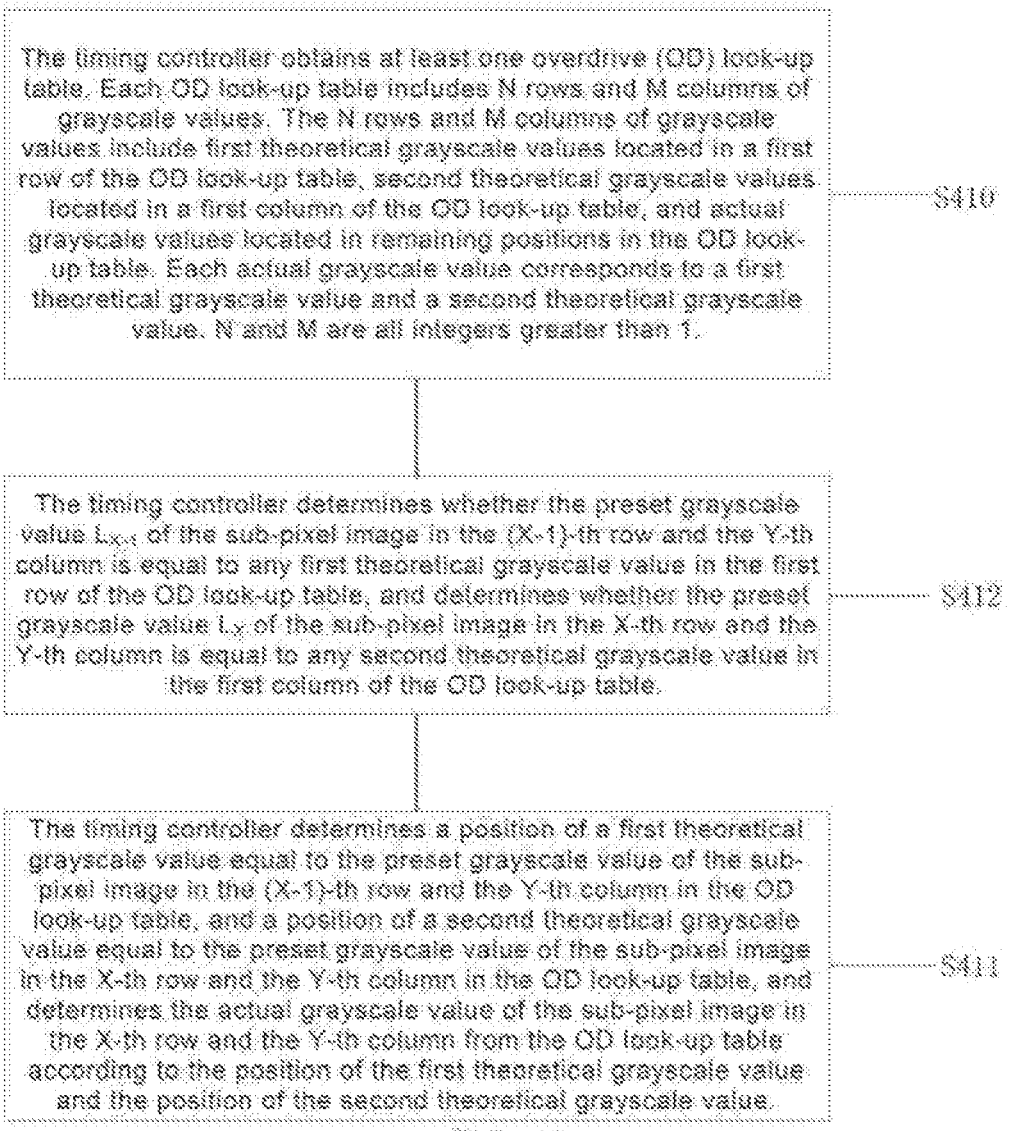
FIG. 19 is another flow diagram of the S41 in the display driving method shown in FIG. 2, in accordance with some embodiments.

In some embodiments, as shown in FIG. 19, before the S411 and after the S410, the display driving method further includes S412.

In S412, the timing controller determines whether the preset grayscale value $L_{X-1}$ of the sub-pixel image in the (X−1)-th row and the Y-th column is equal to any first theoretical grayscale value in the first row of the OD look-up table, and determines whether the preset grayscale value $L_X$ of the sub-pixel image in the X-th row and the Y-th column is equal to any second theoretical grayscale value in the first column of the OD look-up table.

The display driving processes may be different for different results, and will be described in detail below.

In some examples, after the S412, the display driving method further includes the following process.

In S413, in response to determining that the preset grayscale value $L_{X-1}$ is not equal to any first theoretical grayscale value, and the preset grayscale value $L_X$ is equal to a second theoretical grayscale value, the timing controller selects a third theoretical grayscale value B1 and a fourth theoretical grayscale value C1 nearest to $L_{X-1}$ from the first row of the OD look-up table, wherein $L_{X-1}$ is greater than B1, and is less than C1.

In S414, the timing controller determines a position of the third theoretical grayscale value B1 in the OD look-up table, a position of the fourth theoretical grayscale value C1 in the OD look-up table, and a position of this second theoretical grayscale value in the OD look-up table.

In S415, the timing controller determines a first adjustment grayscale value L1 of the sub-pixel image in the X-th row and the Y-th column from the OD look-up table according to the position of the third theoretical grayscale value B1 and the position of this second theoretical grayscale value, and a second adjustment grayscale value H1 of the sub-pixel image in the X-th row and the Y-th column from the OD look-up table according to the position of the fourth theoretical grayscale value C1 and the position of this second theoretical grayscale value.

It will be noted that, the first adjustment grayscale value L1 may be determined once the position of the third theoretical grayscale value B1 and the position of the second theoretical grayscale value are determined. The second adjustment grayscale value H1 may also be determined once the position of the fourth theoretical grayscale value C1 and the position of the second theoretical grayscale value are determined. In other words, the order of the steps in S413, S414 and S415 may be changed according to actual situations, as long as the first adjustment grayscale value L1 and the second adjustment grayscale value H1 can be obtained.

In S416, the timing controller determines an actual grayscale value $L_{XY}$ of the sub-pixel image in the X-th row and the Y-th column according to a first formula or a second formula:

The first formula is: $L_{XY}=L1+\lfloor(H1-L1)/(C1-B1)\rfloor\times(L_{X-1}-B1)$.

The second formula is: $L_{XY}=H1-\lfloor(H1-L1)/(C1-B1)\rfloor\times(C1-L_{X-1})$.

Where symbol $\lfloor\ \rfloor$ is a floor function.

In some other examples, after the S412, the display driving method further includes the following process.

In S417, in response to determining that the preset grayscale value $L_X$ is not equal to any second theoretical grayscale value and the preset grayscale value $L_{X-1}$ is equal to a first theoretical grayscale value, the timing controller selects a fifth theoretical grayscale value B2 and a sixth theoretical grayscale value C2 nearest to $L_X$ from the first column of the OD look-up table, wherein $L_X$ is greater than B2, and is less than C2.

In S418, the timing controller determines a position of the fifth theoretical grayscale value B2 in the OD look-up table, a position of the sixth theoretical grayscale value C2 in the OD look-up table, and a position of this first theoretical grayscale value in the OD look-up table.

In S419, the timing controller determines a third adjustment grayscale value L2 of the sub-pixel image in the X-th row and the Y-th column from the OD look-up table according to the position of the fifth theoretical grayscale value B2 and the position of this first theoretical grayscale value, and a fourth adjustment grayscale value H2 of the sub-pixel image in the X-th row and the Y-th column from the OD look-up table according to the position of the sixth theoretical grayscale value C2 and the position of this first theoretical grayscale value.

It will be noted that, the third adjustment grayscale value L2 may be determined once the position of the fifth theoretical grayscale value B2 and the position of the first theoretical grayscale value are determined. The fourth adjustment grayscale value H2 may also be determined once the position of the sixth theoretical grayscale value C2 and the position of the first theoretical grayscale value are determined. In other words, the order of the steps in S417, S418 and S419 may be changed according to actual situations, as long as the third adjustment grayscale value L2 and the fourth adjustment grayscale value H2 can be obtained.

In S420, the timing controller determines the actual grayscale value $L_{XY}$ of the sub-pixel image in the X-th row and the Y-th column according to a third formula or a fourth formula:

The third formula is: $L_{XY}=L2+\lfloor(H2-L2)/(C2-B2)\rfloor\times(L_X-B2)$.

The fourth formula is: $L_{XY}=H2-\lfloor(H2-L2)/(C2-B2)\rfloor\times(C2-L_X)$.

Where symbol $\lfloor\ \rfloor$ is a floor function.

In some other examples, if the preset grayscale value $L_{X-1}$ is equal to a first theoretical grayscale value, and the preset grayscale value $L_X$ is equal to a second theoretical grayscale value, the S411 is performed.

In some other examples, after the S412, the display driving method includes the following process.

In S421, in response to determining that the preset grayscale value $L_{X-1}$ is not equal to any first theoretical grayscale value, and the preset grayscale value $L_X$ is not equal to any second theoretical grayscale value, the timing controller selects the third theoretical grayscale value B1 and the fourth theoretical grayscale value C1 nearest to $L_{X-1}$ from the first row of the OD look-up table, and selects the fifth theoretical grayscale value B2 and the sixth theoretical grayscale value C2 nearest to $L_X$ from the first column of the OD look-up table.

In S422, the timing controller determines the position of the third theoretical grayscale value B1 in the OD look-up table, the position of the fourth theoretical grayscale value C1 in the OD look-up table, the position of the fifth theoretical grayscale value B2 in the OD look-up table, and the position of the sixth theoretical grayscale value C2 in the OD look-up table.

In S423, the timing controller determines a fifth adjustment grayscale value L3 of the sub-pixel image in the X-th row and the Y-th column from the OD look-up table according to the position of the third theoretical grayscale value B1 and the position of the fifth theoretical grayscale value B2; a sixth adjustment grayscale value H3 of the sub-pixel image in the X-th row and the Y-th column from the OD look-up table according to the position of the fourth theoretical grayscale value C1 and the position of the fifth theoretical grayscale value B2; a seventh adjustment grayscale value L4 of the sub-pixel image in the X-th row and the Y-th column from the OD look-up table according to the position of the third theoretical grayscale value B1 and the position of the sixth theoretical grayscale value C2; and an eighth adjustment grayscale value H4 of the sub-pixel image in the X-th row and the Y-th column from the OD look-up table according to the position of the fourth theoretical grayscale value C1 and the position of the sixth theoretical grayscale value C2.

It will be noted that, the fifth adjustment grayscale value L3 may be determined once the position of the third theoretical grayscale value B1 and the position of the fifth theoretical grayscale value B2 are determined. The sixth adjustment grayscale value H3 may also be determined once the position of the fourth theoretical grayscale value C1 and the position of the fifth theoretical grayscale value B2 are determined. The seventh adjustment grayscale value L4 may also be determined once the position of the third theoretical grayscale value B1 and the position of the sixth theoretical grayscale value C2 are determined. The eighth adjustment grayscale value H4 may also be determined once the position of the fourth theoretical grayscale value C1 and the position of the sixth theoretical grayscale value C2 are determined. In other words, the order of the steps in S4421, S422 and S423 may be changed according to actual situations, as long as the fifth to eighth adjustment grayscale values can be obtained.

In S424, the timing controller determines a first estimated grayscale value $L_{E1}$ of the sub-pixel image in the X-th row and the Y-th column according to a fifth formula or a sixth formula:

The fifth formula is: $L_{E1}=L3+\lfloor(H3-L3)/(C1-B1)\rfloor\times(L_{X-1}-B1)$.

The sixth formula is: $L_{E1}=H3-\lfloor(H3-L3)/(C1-B1)\rfloor\times(C1-L_{X-1})$.

Where symbol $\lfloor\ \rfloor$ is a floor function.

In S425, the timing controller determines a second estimated grayscale value $L_{E2}$ of the sub-pixel image in the X-th row and the Y-th column according to a seventh formula or an eighth formula:

The seventh formula is: $L_{E2}=L4+\lfloor(H4-L4)/(C1-B1)\rfloor\times(L_{X-1}-B1)$.

The eighth formula is: $L_{E2}=H4-\lfloor(H4-L4)/(C1-B1)\rfloor\times(C1-L_{X-1})$.

Where symbol $\lfloor\ \rfloor$ is a floor function.

In S426, the timing controller determines the actual grayscale value $L_{XY}$ of the sub-pixel image in the X-th row and the Y-th column according to a ninth formula or a tenth formula, and the first estimated grayscale value $L_{E1}$ and the second estimated grayscale value $L_{E2}$:

The ninth formula is: $L_{XY}=L_{E1}+\lfloor(L_{E2}-L_{E1})/(C2-B2)\rfloor\times(L_X-B2)$.

The tenth formula is: $L_{XY}=L_{E2}-\lfloor(L_{E2}-L_{E1})/(C2-B2)\rfloor\times(C2-L_X)$.

A result obtained by the floor function is the largest integer not greater than the independent variable. For example, the results of $\lfloor 3.1\rfloor$ and $\lfloor 3.9\rfloor$ are the same, and are both 3. The results of $\lfloor -2.1\rfloor$ and $\lfloor -2.9\rfloor$ are the same, and are both −3.

It will be noted that the order of the S424 and the S425 may be changed. For example, the S425 may be performed before the S424, or the S424 and the S425 may be performed simultaneously.

In addition, the method described above is suitable for the first OD look-up table and the second OD look-up table.

The process of obtaining the actual grayscale value $L_{XY}$ of the sub-pixel image in the X-th row and the Y-th column is described by taking an example where the preset grayscale value $L_X$ of the sub-pixel image in the X-th row and the Y-th column is not equal to any second theoretical grayscale value in the first column of the first OD look-up table.

Firstly, according to a position of the preset grayscale value $L_X$ in the first OD look-up table, a sixth theoretical grayscale value C2 greater than $L_X$ and nearest to $L_X$ and a fifth theoretical grayscale value B2 less than $L_X$ and nearest to $L_X$ are obtained. Then, in the first OD look-up table, the third adjustment grayscale value L2 of the sub-pixel image in the X-th row and the Y-th column is obtained according to the position of a first theoretical grayscale value equal to the preset grayscale value of the sub-pixel image in the (X−1)-th row and the Y-th column and the position of the fifth theoretical grayscale value B2; and the fourth adjustment grayscale value H2 of the sub-pixel image in the X-th row and the Y-th column is obtained according to the position of the first theoretical grayscale value equal to the preset grayscale value of the sub-pixel image in the (X−1)-th row and the Y-th column and the position of the sixth theoretical grayscale value C2. Then, a difference R is obtained by subtracting B2 from C2. A first difference is obtained by subtracting L2 from H2, and the first difference is divided into R equal parts, so as to obtain R-equal-part differences. Then, a second difference is obtained by subtracting B2 from $L_X$, or a third difference is obtained by subtracting $L_X$ from C2. A first grayscale difference D1 is obtained by multiplying the second difference by the R-equal-part difference, or a second grayscale difference D2 is obtained by multiplying the third difference by the R-equal-part difference. Then, the actual grayscale value of the sub-pixel image in the X-th row and the Y-th column is obtained by adding L2 and the first grayscale difference D1, or by subtracting the second grayscale difference value D2 from H2.

It will be noted that, if decimals are encountered in the above calculation process, they will be rounded and then calculated.

For example, if the preset grayscale value $L_X$ of the sub-pixel image in the X-th row and the Y-th column is 14, based on the first OD look-up table shown in FIG. 9, it is determined that C2 is 16, B2 is 8, and R is 8. If the preset grayscale value $L_{X-1}$ of the sub-pixel image in the (X−1)-th row and the Y-th column is 80, the third adjustment grayscale value L2 is 8 by looking up the first OD look-up table, and the fourth adjustment grayscale value H2 is 16 by looking up the first OD look-up table. After dividing the value obtained by subtracting L2 from H2 into equal parts, a value of each equal part is 1. A difference obtained by subtracting B2 from $L_X$ is 6, and in this case, the first grayscale difference D1 equals to 6×1, and then 8 plus 6 is 14. Alternatively, a difference obtained by subtracting $L_X$ from C2 is 2, and in this case, the second grayscale difference D2 equals to 2×1, and then 16 minus 2 is 14. Therefore, the actual grayscale value of the sub-pixel image in the X-th row and the Y-th column is 14.

In some embodiments, the display driving method further includes: reading, by the timing controller, the first OD look-up table and the second OD look-up table from a non-volatile memory when the liquid crystal display apparatus is turned on, and storing, by the timing controller, the first OD look-up table and the second OD look-up table in a memory of the timing controller. In this way, the processing efficiency of the timing controller may be improved.

Figure 11:
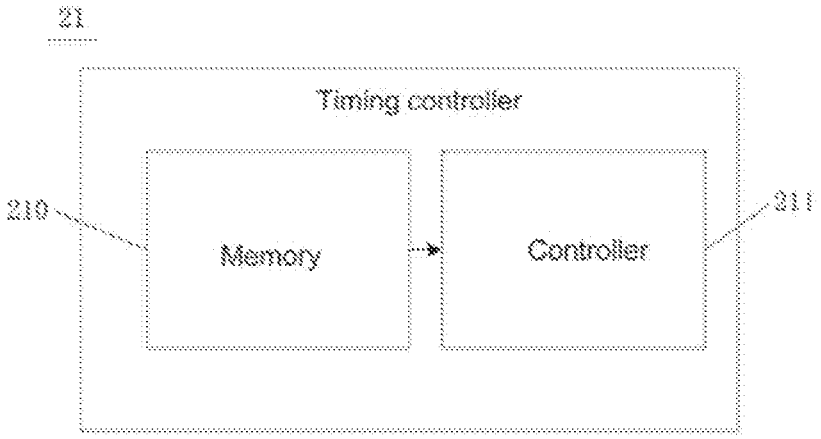
FIG. 11 is a block diagram of a timing controller, in accordance with some embodiments.

As shown in FIG. 11, some embodiments of the present disclosure provide a timing controller 21, and the timing controller 21 includes a memory 210 and a controller 211.

The memory 210 is configured to store at least one OD look-up table. Each OD look-up table includes N rows and M columns of grayscale values. The N rows and M columns of grayscale values include first theoretical grayscale values located in a first row of the OD look-up table, second theoretical grayscale values located in a first column of the OD look-up table, and actual grayscale values located in remaining positions (a position in a second row and a second column to a position in an N-th row and an M-th column) in the OD look-up table. Each actual grayscale value corresponds to a first theoretical grayscale value and a second theoretical grayscale value. N and M are all integers greater than 1.

In some examples, the memory 210 may be a register, a read-only memory (ROM), a random access memory (RAM), or electrically erasable programmable read-only memory (EEPROM).

The controller 211 is configured to retrieve an OD look-up table from the memory 210; and for the image frame to be displayed, determine a position of a first theoretical grayscale value equal to the preset grayscale value of the sub-pixel image in the (X−1)-th row and the Y-th column in the OD look-up table and a position of a second theoretical grayscale value equal to the preset grayscale value of the sub-pixel image in the X-th row and the Y-th column in the OD look-up table; and determine and output the actual grayscale value of the sub-pixel image in the X-th row and the Y-th column from the OD look-up table according to the position of the first theoretical grayscale value and the position of the second theoretical grayscale value. The image frame to be displayed includes J rows and Q columns of sub-pixel images, X is greater than or equal to 2, and is less than or equal to J; Y is greater than or equal to 1, and is less than or equal to Q, and X, Y, J, and Q are all integers greater than 1.

In some examples, the controller 50 may be part of or include an application specific integrated circuit (ASIC); an electronic circuit; a combinational logic circuit; a field programmable gate array (FPGA); a processor (shared, dedicated, or group) that executes code; other suitable hardware components that provide the described functionality; or a combination of some or all of the above, such as in a system-on-chip.

With regard to the benefit effects of the timing controller 21, reference may be made to the method described above, and details will not be repeated here.

Figure 12:
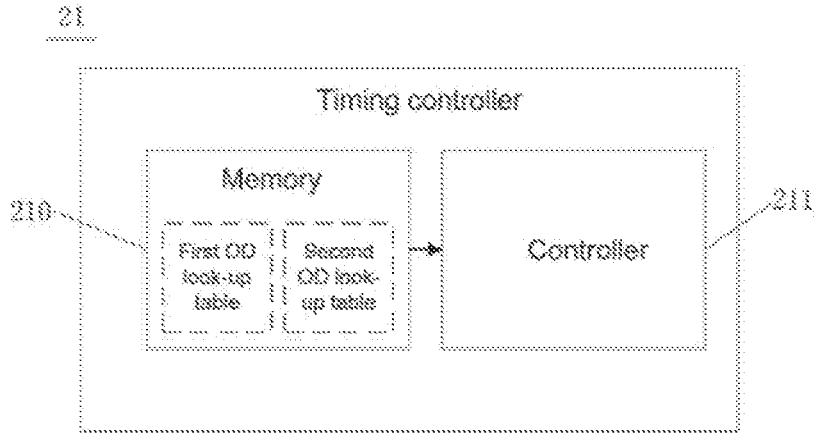
FIG. 12 is a block diagram of another timing controller, in accordance with some embodiments.

In some embodiments, as shown in FIG. 12, the at least one OD look-up table includes a first OD look-up table and a second OD look-up table. The first OD look-up table and the second OD look-up table may be stored in the memory 210.

A grayscale value in a first row and a T-th column of the first OD look-up table is equal to a grayscale value in a first row and a T-th column of the second OD look-up table, and a grayscale value in a K-th row and a first column of the first OD look-up table is equal to a grayscale value in a K-th row and a first column of the second OD look-up table. An actual grayscale value in the K-th row and the T-th column of the first OD look-up table is greater than or equal to an actual grayscale value in the K-th row and the T-th column of the second OD look-up table. All actual grayscale values in the first OD look-up table are not completely equal, and all actual grayscale values in the second OD look-up table are not completely equal. T is greater than or equal to 2, and is less than or equal to M, and T is an integer. K is greater than or equal to 2, and is less than or equal to N. And T and K are both integers.

In this case, the controller 211 is configured to determine whether a pulse width modulation signal used to drive at least one light source of the backlight module to emit light is at a high level or a low level. The controller 211 is further configured to: in response to determining that the pulse width modulation signal is at a high level, retrieve the first OD look-up table from the memory 210; and for the image frame to be displayed, determine a position of a first theoretical grayscale value equal to the preset grayscale value of the sub-pixel image in the (X−1)-th row and the Y-th column in the first OD look-up table, and a position of a second theoretical grayscale value equal to the preset grayscale value of the sub-pixel image in the X-th row and the Y-th column in the first OD look-up table, and determine the actual grayscale value of the sub-pixel image in the X-th row and the Y-th column from the first OD look-up table according to the position of the first theoretical grayscale value and the position of the second theoretical grayscale value. The controller 211 is further configured to: in response to determining that the pulse width modulation signal is at a low level, retrieve the second OD look-up table from the memory 210; and for the image frame to be displayed, determine a position of a first theoretical grayscale value equal to the preset grayscale value of the sub-pixel image in the (X−1)-th row and the Y-th column in the second OD look-up table, and a position of a second theoretical grayscale value equal to the preset grayscale value of the sub-pixel image in the X-th row and the Y-th column in the second OD look-up table, and determine the actual grayscale value of the sub-pixel image in the X-th row and the Y-th column from the second OD look-up table according to the position of the first theoretical grayscale value and the position of the second theoretical grayscale value.

With regard to the first OD look-up table and the second OD look-up table, reference may be made to the above description, and details are not repeated here. As can be seen from the foregoing description, in the first OD look-up table and the second OD look-up table, the actual grayscale values of each row are not completely equal to the second theoretical grayscale value.

For example, the theoretical grayscale values and the actual grayscale values in the first OD look-up table and the second OD look-up table are both stored in the memory 210 in a form of binary data.

For example, the controller 211 outputs the actual grayscale value in a binary form. The controller 211, for example, outputs the actual grayscale values of the sub-pixels in sequence.

It can be known from the above description that, when the backlight is on and off, the time taken for the driving voltage of the sub-pixel to rise to a preset value is different. The longer the time taken for the driving voltage to rise to the preset value is, the shorter the charging time is. The ideal time taken for the driving voltage to rise to the preset value is zero. In the embodiments of the present disclosure, different OD look-up tables (i.e., the first OD look-up table and the second OD look-up table) are used, so that the time taken for the driving voltage of the sub-pixel to rise to the preset value is approximately equal to zero when the backlight is on and off. That is, by reducing the delay time for the driving voltage of the sub-pixel to rise to the preset value, the charging rate of the sub-pixel is enhanced, and the display brightness of the sub-pixel is improved.

In these embodiments, the first OD look-up table is provided to be used when the backlight is on, and the second OD look-up table is provided to be used when the backlight is off. Since the actual grayscale value in the K-th row and the T-th column of the first OD look-up table is greater than or equal to the actual grayscale value in the K-th row and the T-th column of the second OD look-up table, the actual grayscale values determined by the first OD look-up table and the second OD look-up table may reduce the impact of light on the rising time of the driving voltage of the sub-pixel. It may be ensured that the time taken for the driving voltage to rise to the preset value when the backlight is on is approximately equal to the time taken for the driving voltage to rise to the preset value when the backlight is off. Therefore, the charging rate of the liquid crystal display panel may be increased, and the display brightness of the liquid crystal display panel as a whole may be improved.

When the liquid crystal display panel is driven to display an image frame, regardless of whether the first OD look-up table or the second OD look-up table is used, the actual grayscale value of the sub-pixel image in the X-th row and the Y-th column is determined from the first OD look-up table or the second OD look-up table according to the first theoretical grayscale value and the second theoretical grayscale value. Then, the actual grayscale value is converted into a driving voltage of the sub-pixel in the X-th row and the Y-th column in the liquid crystal display panel when the liquid crystal display panel is driven.

For example, the actual grayscale value in the K-th row of the first OD look-up table floats within a range of a difference between this preset grayscale value and 10 to a sum of this preset grayscale value and 10. The actual grayscale values in the K-th row of the second OD look-up table floats within a range of a difference between this preset grayscale values and 5 to a sum of this preset grayscale values and 5. Within the above floating range, each actual grayscale value of the K-th row may be obtained through experiments. In an experiment, different driving voltage values are input to the liquid crystal display panel, and whether the waterfall defect exists on the liquid crystal display panel is observed. If an input driving voltage value makes the liquid crystal display panel free of water fall defect, a grayscale value corresponding to the driving voltage value is used as the actual grayscale value of the K-th row.

Still taking FIG. 6 as an example, when the backlight is off, the second OD look-up table is used to make the green sub-pixels G in the second row and fourth row be driven by the driving voltages corresponding to the actual grayscale value 193, resulting in achieving the uniform brightness of the green sub-pixels G in the first, second, third, and fourth rows. When the backlight is on, the first OD look-up table is used to make the green sub-pixels G in the second and fourth rows be driven by the driving voltages corresponding to the actual grayscale value 195, resulting in achieving the uniform brightness of the green sub-pixels G of the first, second, third, and fourth rows.

In some embodiments, the controller 211 is further configured to retrieve the first OD look-up table and the second OD look-up table from a non-volatile memory, and store them in the memory 210.

The non-volatile memory may include read-only memory (ROM) or flash memory (flash). The first OD look-up table and the second OD look-up table may be stored in the non-volatile memory in advance, and then the controller 21 may retrieve them from the non-volatile memory, and store them in the memory 210.

The non-volatile memory can store data for along time without current supply. In this way, it may be convenient for the timing controller 21 to retrieve the first OD look-up table and the second OD look-up table and may avoid data loss due to power failure.

In some embodiments, the controller 211 is further configured to receive the PWM signal and a clock signal. For example, the PWM signal is provided by a System on Chip (SOC). In addition, the SOC may also provide the PWM signal to the backlight driving circuit 34 of the backlight module 3.

In this case, the controller 211 is configured to, within each clock cycle of the clock signal, obtain the first OD look-up table from the memory 210 in response to determining that the pulse width modulation signal is at the high level, and obtain the second OD look-up table from the memory 210 in response to determining that the pulse width modulation signal is at the low level.

The clock signal is used to enable the timing controller 21 to output an actual grayscale value in each clock cycle. Each clock cycle includes a high-level duration and a low-level duration. For example, the actual grayscale value of the sub-pixel image may be output during the high-level duration of the clock cycle. In this way, it may be ensured that the timing controller 21 accurately outputs data representing the actual grayscale value when the PWM signal is at the high level.

In some embodiments, as shown in FIGS. 9 and 10, in the first OD look-up table and the second OD look-up table, the grayscale values from the second column to the M-th column in the first row increase in sequence, and the grayscale values from the second row to the N-th row in the first column increase in sequence. The grayscale value in the second row and the first column is a minimum theoretical grayscale value, and the actual grayscale values from the second column to the M-th column in the second row are all equal to the minimum theoretical grayscale value. The minimum theoretical grayscale value may be zero. The grayscale value in the N-th row and the first column is a maximum theoretical grayscale value, and the actual grayscale values from the second column to the M-th column in the N-th row are all equal to the maximum theoretical grayscale value.

In some example, a grayscale range displayed on the liquid crystal display panel is 0 to 255, and the maximum theoretical grayscale value is 255. In some other examples, a grayscale range displayed on the liquid crystal display panel is 0 to 63, and the maximum theoretical grayscale value is 63. In some other examples, a grayscale range displayed on the liquid crystal display panel is 0 to 1023, and the maximum theoretical grayscale value is 1023.

In addition, for a third row to an (N−1)-th row, the actual grayscale values from the second column to the M-th column in each row change in a decreasing trend. That is, a grayscale value of the K-th row and the T-th column is greater than or equal to a grayscale value of the K-th row and the (T+1)-th column, and the grayscale values in the same row are not completely the same.

A case where the grayscale range of a sub-pixel of the liquid crystal display panel is from 0 to 255 is taken as an example. When a grayscale value of a sub-pixel image corresponding to the sub-pixel is zero, the brightness of the sub-pixel is minimum, and the actual grayscale value is zero. When the grayscale value of the sub-pixel image corresponding to the sub-pixel is 255, the brightness of the sub-pixel is maximum, the actual grayscale value is 255.

In some other embodiments, in the first OD look-up table and the second OD look-up table, the grayscale values from the second column to the M-th column in the first row increase in sequence, and the grayscale values from the second row to the N-th row in the first column increase in sequence. The grayscale value in the second row and the first column is greater than the minimum theoretical grayscale value, and the grayscale value in the N-th row and the first column is less than the maximum theoretical grayscale value. For the second row to the N-th row, the actual grayscale values from the second column to the M-th column in each row change in a decreasing trend.

For example, N and M are both 8, the first OD look-up table is shown as Table 2. It can be seen that, the first OD look-up table do not include the minimum theoretical grayscale value and the maximum theoretical grayscale value.

TABLE 2

| First OD look-up table | 8 | 32 | 64 | 96 | 128 | 160 | 192 |
|---|---|---|---|---|---|---|---|
| 8 | 9 | 8 | 8 | 8 | 8 | 8 | 8 |
| 32 | 36 | 34 | 32 | 32 | 31 | 30 | 30 |
| 64 | 69 | 68 | 66 | 64 | 63 | 62 | 62 |
| 96 | 105 | 102 | 99 | 97 | 96 | 95 | 94 |
| 128 | 140 | 137 | 133 | 131 | 129 | 128 | 128 |
| 160 | 171 | 169 | 167 | 165 | 162 | 160 | 160 |
| 192 | 201 | 200 | 200 | 200 | 196 | 194 | 192 |

In some embodiments, a liquid crystal display apparatus is provided. The liquid display apparatus may be any product or component having a display function, such as a mobile phone, a tablet computer, a television, a display, a notebook computer, a digital photo frame, or a navigator.

Figure 13:
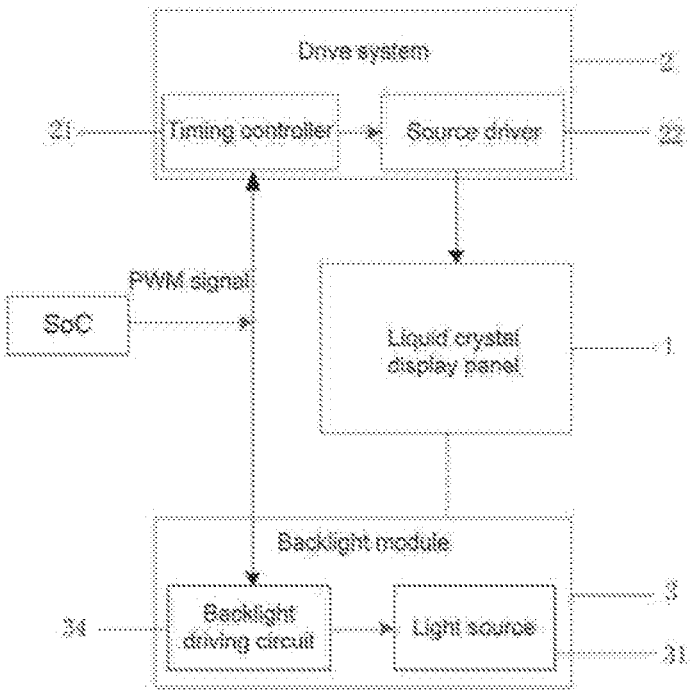
FIG. 13 is a block diagram of a liquid crystal display apparatus, in accordance with some embodiments.

As shown in FIG. 13, the liquid crystal display apparatus includes a liquid crystal display panel 1, a backlight module 3, and a drive system 2.

Figure 14:
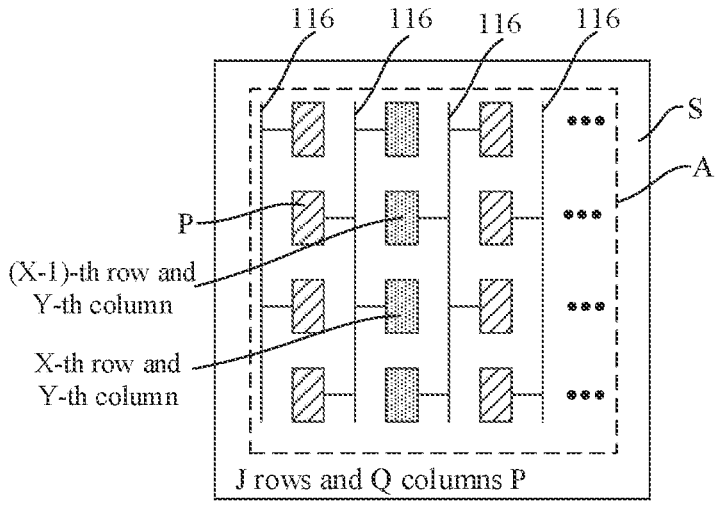
FIG. 14 is a top view of a liquid crystal display panel, in accordance with some embodiments.

As shown in FIG. 14, the liquid crystal display panel 1 has a display area A and a peripheral region S. For example, the peripheral region S is arranged around the display area A. The liquid crystal display panel 1 includes a plurality of sub-pixels P located in the display area A and a plurality of data lines 116. As shown in FIG. 14, the plurality of sub-pixels P include at least a plurality of first color sub-pixels, a plurality of second color sub-pixels and a plurality of third color sub-pixels. The first color, the second color and the third color are three primary colors (e.g., red, green and blue, respectively).

As shown in FIG. 13, the backlight module 3 includes a backlight driving circuit 34 and at least one light source 31 electrically connected to the backlight driving circuit 34. The backlight driving circuit 34 is configured to drive the at least one light source 31 according to a pulse width modulation signal.

As shown in FIG. 13, the drive system 2 includes the timing controller 21 and at least one source driver 22. The timing controller 21 is electrically connected to the backlight driving circuit 34 and the at least one source driver 22. The at least one source driver 22 is further electrically connected the plurality of data line 116 in the liquid crystal display panel 1. For example, the source driver 22 is a source driver integrated circuit (source IC). The at least one source driver 22 is configured to receive the actual grayscale value of the sub-pixel image in the X-th row and the Y-th column output by the timing controller 21, and provide a voltage signal to a corresponding data line 116 according to the actual grayscale value.

In each clock cycle of the clock signal, the timing controller 21 obtains the first OD look-up table from its memory 210 in response to determining that the PWM signal is at a high level, and outputs the determined actual grayscale value; and obtains the second OD look-up table from its memory 210 in response to determining that the PWM signal is at a low level, and outputs the determined actual grayscale value.

Figure 17:
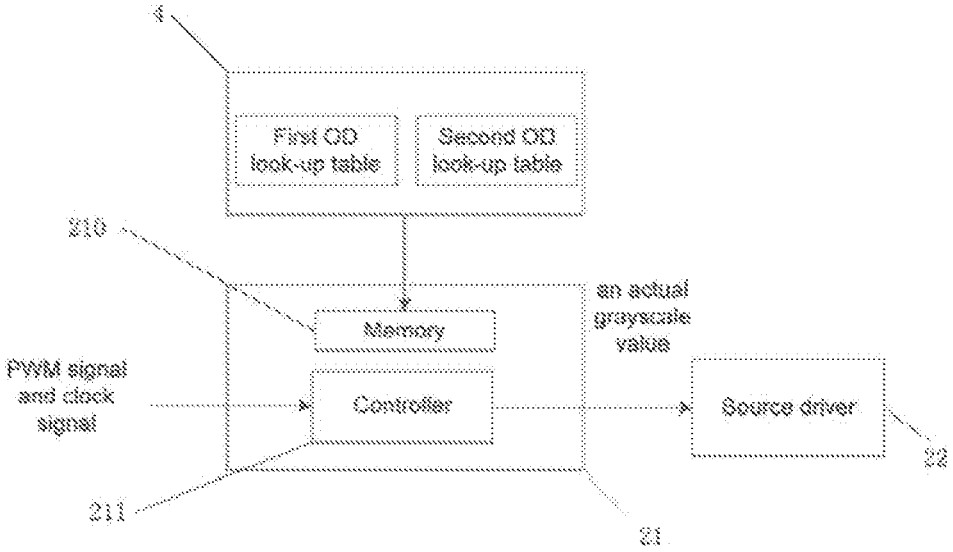
FIG. 17 is a block diagram of another liquid crystal display apparatus, in accordance with some embodiments.

In some embodiments, as shown in FIG. 17, the liquid crystal display apparatus further includes a non-volatile memory 4 that is configured to store the first OD look-up table and the second OD look-up table.

Figure 18A:
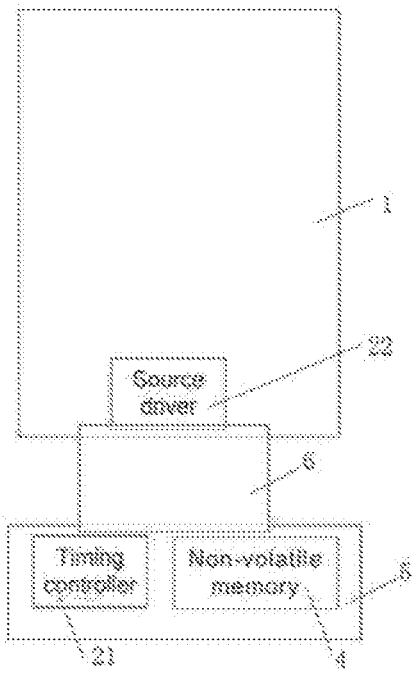
FIG. 18A is a block diagram of another liquid crystal display apparatus, in accordance with some embodiments.

In some embodiments, as shown in FIG. 18A, the liquid crystal display apparatus further includes a circuit board 5 and a first flexible printed circuit board 6. The at least one source driver 22 is disposed on the liquid crystal display panel 1, and the timing controller 21 and the non-volatile memory 4 are disposed on the circuit board 5. The liquid crystal display panel 1 and the circuit board 5 are connected through the first flexible printed circuit board 6.

Figure 18B:
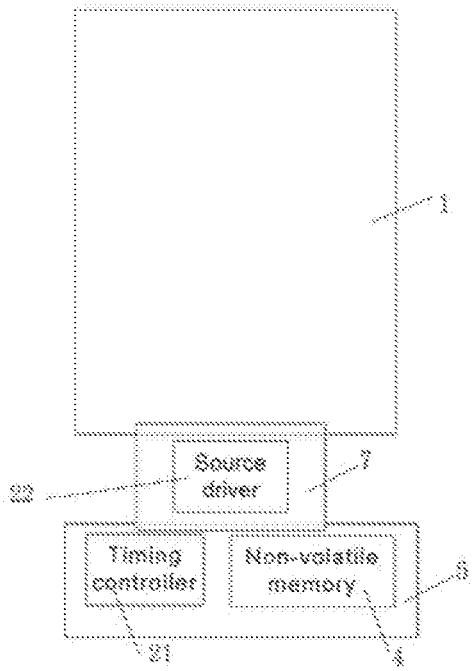
FIG. 18B is a block diagram of yet another liquid crystal display apparatus, in accordance with some embodiments.

In some other embodiments, as shown in FIG. 18B, the liquid crystal display apparatus further includes a circuit board 5 and a second flexible printed circuit board 7. The at least one source driver 22 is disposed on the second flexible printed circuit board 7, and the timing controller 21 and the non-volatile memory 4 are disposed on the circuit board 5. One edge of the second flexible printed circuit board 7 is bonded to the liquid crystal display panel 1, and an opposite edge of the second flexible printed circuit board 7 is connected to the circuit board 5.

For the convenience of description, the plurality of sub-pixels P arranged in an array will be taken as an example. In this case, sub-pixels P arranged in a row in the horizontal direction are referred to as sub-pixels of the same row, and sub-pixels P arranged in a column in the vertical direction are referred to as sub-pixels of the same column.

As shown in FIG. 14, in two adjacent columns of sub-pixels P, sub-pixels P in the odd rows and one column and sub-pixels P in the even rows and another column may be connected to the same data line 116. Of course, it may also be that sub-pixels P in the same column are connected to one data line 116. In addition, sub-pixels P in the same row may be connected to one gate line.

Figure 15:
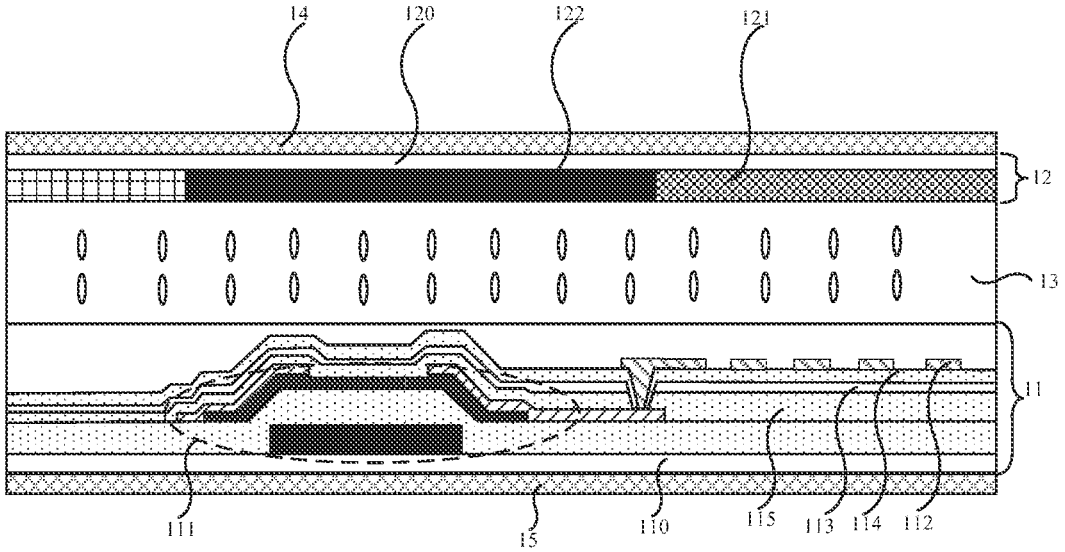
FIG. 15 is a schematic diagram showing a structure of another liquid crystal display panel, in accordance with some embodiments.

For example, as shown in FIG. 15, the liquid crystal display panel 1 includes an array substrate 11, an opposite substrate 12, and a liquid crystal layer 13 disposed between the array substrate 11 and the opposite substrate 12.

As shown in FIG. 15, the array substrate 11 has a plurality of sub-pixel regions each corresponding to a corresponding sub-pixel. The array substrate 11 includes a first base 10, and a thin film transistor 111 and a pixel electrode 112 disposed in each sub-pixel region on the first base 110. The thin film transistor 111 includes an active layer, a source, a drain, a gate, and a portion of a gate insulating layer located in a region where the thin film transistor 111 is located. The source and the drain are in contact with the active layer, the pixel electrode 112 is electrically connected to the drain of the thin film transistor 111, and the source of the thin film transistor 111 is electrically connected to the data line 116. In some embodiments, as shown in FIG. 15, the array substrate 11 further includes a common electrode 113 disposed on the first base 110.

It will be understood that when a layer or element is referred to as being "on" another layer or substrate, it can be directly on the other layer or substrate, or intervening layers may also be present.

In some examples, the pixel electrode 112 and the common electrode 113 are disposed in the same layer. The pixel electrode 112 and the common electrode 113 are both comb structures including a plurality of strip-shaped sub-electrodes.

In some other examples, the pixel electrode 112 and the common electrode 113 are disposed in different layers. In this case, as shown in FIG. 15, the array substrate further includes a first insulating layer 114 disposed between the pixel electrode 112 and the common electrode 113.

For example, the common electrode 113 is disposed between the thin film transistors 111 and the pixel electrodes 112, and as shown in FIG. 15, the array substrate further includes a second insulating layer 115 disposed between the common electrode 113 and the thin film transistors 111.

In some other embodiments, the common electrode 113 is included in the opposite substrate 12.

As shown in FIG. 15, the opposite substrate 12 includes a second base 120 and a color filter layer 121 disposed on the second base 120. In this case, the opposite substrate 12 may also be referred to as a color filter substrate. The color filter layer 121 includes a plurality of red photoresist units, a plurality of green photoresist units, and a plurality of blue photoresist units. The red photoresist unit, the green photoresist unit and the blue photoresist unit are each disposed in a corresponding sub-pixel region. The opposite substrate 12 further includes a black matrix 122 disposed on the second base 120, and the black matrix 122 is used to space any two adjacent photoresist units of the red photoresist units, the green photoresist units and the blue photoresist units.

In addition, as shown in FIG. 15, the liquid crystal display panel 1 further includes an upper polarizer 14 disposed on a side of the opposite substrate 12 away from the liquid crystal layer 13 and a lower polarizer 15 disposed on a side of the array substrate 11 away from the liquid crystal layer 13.

The backlight module 3 may be an edge-lit backlight module or a direct-lit backlight module.

Figure 16A:
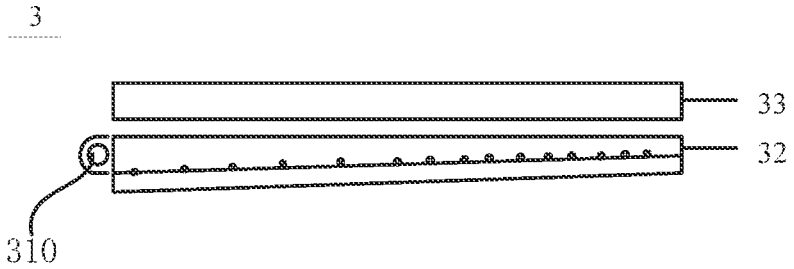
FIG. 16A is a schematic diagram showing a structure of an edge-lit backlight module, in accordance with some embodiments.

As shown in FIG. 16A, the edge-lit backlight module includes a light-emitting diode (LED) strip 310, a light guide plate 32, and a plurality of optical films 33 disposed on a light emitting surface of the light guide plate 32. The plurality of optical films 33 may include at least one diffusion sheet and a brightness enhancement film (BEF). The brightness enhancement film may include a prism film and/or a dual brightness enhancement film (DBEF), and the two may be used in combination.

Figure 16B:
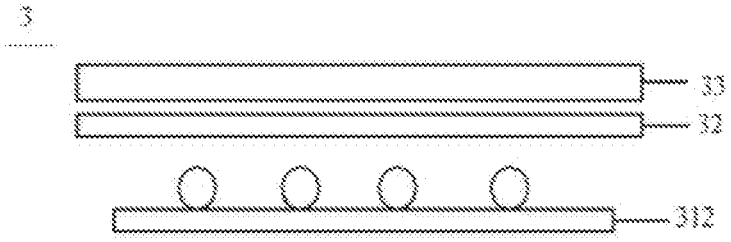
FIG. 16B is a schematic diagram showing a structure of a direct-lit backlight module, in accordance with some embodiments.

As shown in FIG. 16B, the direct-lit backlight module can include a light panel 312 including a plurality of tiny blue LEDs arranged in an array, and a light-emitting direction of the light panel 312 faces the liquid crystal display panel 1. On this basis, as shown in FIG. 16B, the backlight module 3 may further include a light guide plate 32 and a plurality of optical films 33 disposed on the light emitting side of the light guide plate 32.

The LED strip 310 and the light panel 312 in the above embodiments both include at least one light source 31 and a backlight driving circuit 34. The backlight driving circuit 34 is configured to drive the at least one light source 31 to emit light according to the PWM signal.

With regard to the benefit effects of the liquid crystal display apparatus, reference may be made to the timing controller 21, and details will not be repeated here.

A working principle of the liquid crystal display apparatus may be as follows: when the liquid crystal display apparatus is turned on, the controller 211 of the timing controller 21 reads the first OD look-up table and the second OD look-up table from the non-volatile memory 4, and stores the read data in the memory 210. When receiving the PWM signal, the controller 211 firstly determines whether the PWM signal is at a high level or a low level, and then selects the first OD look-up table or the second OD look-up table according to the PWM signal, and outputs the obtained actual grayscale value to the at least one source driver 22. The actual grayscale value output by the controller 211 is a digital signal. After receiving the digital signal, the source driver 22 converts the digital signal into a corresponding analogue voltage, and transmits the analogue voltage to the corresponding data line 116, so as to provide a driving voltage for a sub-pixel. Sub-pixels located in the same row display sub-pixel images simultaneously.

The forgoing descriptions are merely specific implementation manners of the present disclosure, but the protection scope of the present disclosure is not limited thereto. Any person skilled in the art could conceive of changes or replacements within the technical scope of the present disclosure, which shall all be included in the protection scope of the present disclosure. Therefore, the protection scope of the present disclosure shall be subject to the protection scope of the claims.

What is claimed is:

1. A display driving method, comprising:

receiving, by a timing controller, at least one overdrive look-up table, each overdrive look-up table including N rows and M columns of grayscale values, wherein the N rows and M columns of qrayscale values include first theoretical qrayscale values located in a first row of the overdrive look-up table, second theoretical qrayscale values located in a first column of the overdrive look-up table, and actual grayscale values located in remaining positions in the overdrive look-up table; each actual qrayscale value corresponds to a first theoretical qrayscale value and a second theoretical qrayscale value; the at least one overdrive look-up table includes a first overdrive look-up table and a second overdrive look-up table: N and M are all integers greater than 1;

determining, by the timing controller, whether a pulse width modulation signal used to drive at least one light source in a backlight module to emit light is at a high level or a low level;

in response to determining that the pulse width modulation signal is at the high level:

determining, by the timing controller, a position of a first theoretical grayscale value equal to a preset qrayscale value of a sub-pixel image in an (X−1)-th row and a Y-th column of an image frame to be displayed in the first overdrive look-up table, and a position of a second theoretical grayscale value equal to a preset grayscale value of a sub-pixel image in an X-th row and the Y-th column of the image frame to be displayed in the first overdrive look-up table;

determining an actual grayscale value of the sub-pixel image in the X-th row and the Y-th column from the first overdrive look-up table according to the position of the first theoretical qrayscale value and the position of the second theoretical qrayscale value in the first overdrive look-up table; and in response to determining that the pulse width modulation signal is at the low level:

determining, by the timing controller, a position of a first theoretical qrayscale value equal to the preset grayscale value of the sub-pixel image in the (X−1)-th row and the Y-th column in the second overdrive look-up table, and a position of a second theoretical qrayscale value equal to the preset qrayscale value of the sub-pixel image in the X-th row and the Y-th column in the second overdrive look-up table, and determining the actual grayscale value of the sub-pixel image in the X-th row and the Y-th column from the second overdrive look-up table according to the position of the first theoretical grayscale value and the position of the second theoretical grayscale value in the second overdrive look-up table, wherein the image frame to be displayed includes J rows and Q columns of sub-pixel images, X is greater than or equal to 2, and is less than or equal to J, Y is greater than or equal to 1, and is less than or equal to Q, and X, Y, J, and Q are all integers.

2. The display driving method according to claim 1, further comprising:

updating, by the timing controller, the preset grayscale value of the sub-pixel image in the X-th row and the Y-th column of the image frame to be displayed to the actual grayscale value; and outputting, by the timing controller, actual grayscale values of all sub-pixel images of the image frame to be displayed to at least one source driver row by row, so that the at least one source driver drives J rows and Q columns of sub-pixels in a display panel row by row according to the actual grayscale values to display an image frame.

3. The display driving method according to claim 1, wherein a grayscale value in a first row and a T-th column of the first overdrive look-up table is equal to a grayscale value in a first row and a T-th column of the second overdrive look-up table, T is greater than or equal to 2, and is less than or equal to M, and T is a integer;

a grayscale value in a K-th row and a first column of the first overdrive look-up table is equal to a grayscale value in a K-th row and a first column of the second overdrive look-up table, K is greater than or equal to 2, and is less than or equal to N, and K is an integer; and an actual grayscale value in the K-th row and the T-th column of the first overdrive look-up table is greater than or equal to an actual grayscale value in the K-th row and the T-th column of the second overdrive look-up table, all actual grayscale values in the first overdrive look-up table are not completely equal, and all actual grayscale values in the second overdrive look-up table are not completely equal.

4. The display driving method according to claim 1, further comprising:

reading, by the timing controller, the first overdrive look-up table and the second overdrive look-up table from a non-volatile memory when a liquid crystal display apparatus is turned on; and storing, by the timing controller, the first overdrive look-up table and the second overdrive look-up table in a memory of the timing controller.

5. The display driving method according to claim 1, wherein after receiving the at least one overdrive look-up table, and before determining the actual grayscale value of the sub-pixel image in the X-th row and the Y-th column, the display driving method further comprises:

determining, by the timing controller, whether the preset grayscale value $L_{X-1}$ of the sub-pixel image in the (X−1)-th row and the Y-th column is equal to any first theoretical grayscale value in the first row of the overdrive look-up table, and determining, by the timing controller, whether the preset grayscale value $L_X$ of the sub-pixel image in the X-th row and the Y-th column is equal to any second theoretical grayscale value in the first column of the overdrive look-up table.

6. The display driving method according to claim 5, wherein determining the position of the first theoretical grayscale value equal to the preset grayscale value of the sub-pixel image in the (X−1)-th row and the Y-th column in the overdrive look-up table and the position of the second theoretical grayscale value equal to the preset grayscale value of the sub-pixel image in the X-th row and the Y-th column in the overdrive look-up table, and determining the actual grayscale value of the sub-pixel image in the X-th row and the Y-th column from the overdrive look-up table according to the position of the first theoretical grayscale value and the position of the second theoretical grayscale value, includes:

in response to determining that the preset grayscale value $L_{X-1}$ of the sub-pixel image in the (X−1)-th row and the Y-th column is not equal to any first theoretical grayscale value, and the preset grayscale value $L_X$ of the sub-pixel image in the X-th row and the Y-th column is equal to a second theoretical grayscale value:

selecting a third theoretical grayscale value B1 and a fourth theoretical grayscale value C1 nearest to $L_{X-1}$ from the first row of the overdrive look-up table, wherein $L_{X-1}$ is greater than B1, and is less than C1;

determining a position of the third theoretical grayscale value B1 in the overdrive look-up table, a position of the fourth theoretical grayscale value C1 in the overdrive look-up table, and the position of the second theoretical grayscale value in the overdrive look-up table;

determining a first adjustment grayscale value L1 of the sub-pixel image in the X-th row and the Y-th column from the overdrive look-up table according to the position of the third theoretical grayscale value B1 and the position of the second theoretical grayscale value, and a second adjustment grayscale value H1 of the sub-pixel image in the X-th row and the Y-th column from the overdrive look-up according to the position of the fourth theoretical grayscale value C1 and the position of the second theoretical grayscale value; and determining the actual grayscale value $L_{XY}$ of the sub-pixel image in the X-th row and the Y-th column according to a first formula or a second formula, wherein the first formula is: $L_{XY}=L1+\lfloor(H1-L1)/(C1-B1)\rfloor\times(L_{X-1}-B1)$; and the second formula is: $L_{XY}=H1-\lfloor(H1-L1)/(C1-B1)\rfloor\times(C1-L_{X-1})$, wherein symbol $\lfloor\ \rfloor$ is a floor function.

7. The display driving method according to claim 5, wherein determining the position of the first theoretical grayscale value equal to the preset grayscale value of the sub-pixel image in the (X−1)-th row and the Y-th column in the overdrive look-up table and the position of the second theoretical grayscale value equal to the preset grayscale value of the sub-pixel image in the X-th row and the Y-th column in the overdrive look-up table, and determining the actual grayscale value of the sub-pixel image in the X-th row and the Y-th column from the overdrive look-up table according to the position of the first theoretical grayscale value and the position of the second theoretical grayscale value, includes:

in response to determining that the preset grayscale value $L_X$ of the sub-pixel image in the X-th row and the Y-th column is not equal to any second theoretical grayscale value, and the preset grayscale value $L_{X-1}$ of the sub-pixel image in the (X−1)-th row and the Y-th column is equal to a first theoretical grayscale value:

selecting a fifth theoretical grayscale value B2 and a sixth theoretical grayscale value C2 nearest to $L_X$ from the first column of the overdrive look-up table, wherein $L_X$ is greater than B2, and is less than C2;

determining a position of the fifth theoretical grayscale value B2 in the overdrive look-up table, a position of the sixth theoretical grayscale value C2 in the overdrive look-up table, and the position of the first theoretical grayscale value in the overdrive look-up table;

determining a third adjustment grayscale value L2 of the sub-pixel image in the X-th row and the Y-th column from the overdrive look-up table according to the position of the fifth theoretical grayscale value B2 and the position of the first theoretical grayscale value, and a fourth adjustment grayscale value H2 of the sub-pixel image in the X-th row and the Y-th column from the overdrive look-up table according to the position of the sixth theoretical grayscale value C2 and the position of the first theoretical grayscale value; and determining the actual grayscale value $L_{XY}$ of the sub-pixel image in the X-th row and the Y-th column according to a third formula or a fourth formula, wherein the third formula is: $L_{XY}=L2+\lfloor(H2-L2)/(C2-B2)\rfloor\times(L_X-B2)$; and the fourth formula is: $L_{XY}=H2-\lfloor(H2-L2)/(C2-B2)\rfloor\times(C2-L_X)$, wherein symbol $\lfloor\ \rfloor$ is a floor function.

8. The display driving method according to claim 5, wherein determining the position of the first theoretical grayscale value equal to the preset grayscale value of the sub-pixel image in the (X−1)-th row and the Y-th column in the overdrive look-up table and the position of the second theoretical grayscale value equal to the preset grayscale value of the sub-pixel image in the X-th row and the Y-th column in the overdrive look-up table, and determining the actual grayscale value of the sub-pixel image in the X-th row and the Y-th column from the overdrive look-up table according to the position of the first theoretical grayscale value and the position of the second theoretical grayscale value, includes:

in response to determining that the preset grayscale value $L_{X-1}$ of the sub-pixel image in the (X−1)-th row and the Y-th column is not equal to any first theoretical grayscale value, and the preset grayscale value $L_X$ of the sub-pixel image in the X-th row and the Y-th column is not equal to any second theoretical grayscale value:

selecting a third theoretical grayscale value B1 and a fourth theoretical grayscale value C1 nearest to $L_{X-1}$ from the first row of the overdrive look-up table, and selecting a fifth theoretical grayscale value B2 and a sixth theoretical grayscale value C2 nearest to $L_X$ from the first column of the overdrive look-up table, wherein $L_{X-1}$ is greater than B1, and is less than C1; and $L_X$ is greater than B2, and is less than C2;

determining a position of the third theoretical grayscale value B1 in the overdrive look-up table, a position of the fourth theoretical grayscale value C1 in the overdrive look-up table, a position of the fifth theoretical grayscale value B2 in the overdrive look-up table, and a position of the sixth theoretical grayscale value C2 in the overdrive look-up table;

from the overdrive look-up table, determining a fifth adjustment grayscale value L3 of the sub-pixel image in the X-th row and the Y-th column according to the position of the third theoretical grayscale value B1 and the position of the fifth theoretical grayscale value B2, a sixth adjustment grayscale value H3 of the sub-pixel image in the X-th row and the Y-th column according to the position of the fourth theoretical grayscale value C1 and the position of the fifth theoretical grayscale value B2, a seventh adjustment grayscale value L4 of the sub-pixel image in the X-th row and the Y-th column according to the position of the third theoretical grayscale value B1 and the position of the sixth theoretical grayscale value C2, and an eighth adjustment grayscale value H4 of the sub-pixel image in the X-th row and the Y-th column according to the position of the fourth theoretical grayscale value C1 and the position of the sixth theoretical grayscale value C2; and determining a first estimated grayscale value $L_{E1}$ of the sub-pixel image in the X-th row and the Y-th column according to a fifth formula or a sixth formula, wherein the fifth formula is: $L_{E1}=L3+\lfloor(H3-L3)/(C1-B1)\rfloor\times(L_{X-1}-B1)$; and the sixth formula is: $L_{E1}=H3-\lfloor(H3-L3)/(C1-B1)\rfloor\times(C1-L_{X-1})$;

determining a second estimated grayscale value $L_{E2}$ of the sub-pixel image in the X-th row and the Y-th column according to a seventh formula or an eighth formula, wherein the seventh formula is: $L_{E2}=L4+\lfloor(H4-L4)/(C1-B1)\rfloor\times(L_{X-1}-B1)$; and the eighth formula is: $L_{E2}=H4-\lfloor(H4-L4)/(C1-B1)\rfloor\times(C1-L_{X-1})$;

determining the actual grayscale value $L_{XY}$ of the sub-pixel image in the X-th row and the Y-th column according to a ninth formula or a tenth formula, and the first estimated grayscale value $L_{E1}$ and the second estimated grayscale value $L_{E2}$;

wherein the ninth formula is: $L_{XY}=L_{E1}+\lfloor(L_{E2}-L_{E1})/(C2-B2)\rfloor\times(L_X-B2)$; and the tenth formula is: $L_{XY}=L_{E2}-\lfloor(L_{E2}-L_{E1})/(C2-B2)\rfloor\times(C2-L_X)$, wherein symbol $\lfloor\ \rfloor$ is a floor function.

9. A timing controller, comprising:

a memory configured to store at least one overdrive look-up table, each overdrive look-up table including N rows and M columns of grayscale values, wherein the N rows and M columns of grayscale values include first theoretical grayscale values located in a first row of the overdrive look-up table, second theoretical grayscale values located in a first column of the overdrive look-up table, and actual grayscale values located in remaining positions in the overdrive look-up table; each actual grayscale value corresponds to a first theoretical grayscale value and a second theoretical grayscale value; the at least one overdrive look-up table includes a first overdrive look-up table and a second overdrive look-up table; a grayscale value in a first row and a T-th column of the first overdrive look-up table is equal to a qrayscale value in a first row and a T-th column of the second overdrive look-up table, and a grayscale value in a K-th row and a first column of the first overdrive look-up table is equal to a grayscale value in a K-th row and a first column of the second overdrive look-up table; and an actual qrayscale value in the K-th row and the T-th column of the first overdrive look-up table is greater than or equal to an actual grayscale value in the K-th row and the T-th column of the second overdrive look-up table, all actual qrayscale values in the first overdrive look-up table are not completely equal, and all actual grayscale values in the second overdrive look-up table are not completely equal; N and M are all integers greater than 1; T is greater than or equal to 2, and is less than or equal to M; K is greater than or equal to 2, and is less than or equal to N, and T and K are both integers; and a controller configured to:

determine whether a pulse width modulation signal used to drive at least one light source in a backlight module to emit light is at a high level or a low level;

in response to determining that the pulse width modulation signal is at the high level:

retrieve the first overdrive look-up table from the memory; and for an image frame to be displayed:

determine a position of a first theoretical qrayscale value equal to a preset grayscale value of a sub-pixel image in an (X−1)-th row and a Y-th column in the first overdrive look-up table, and a position of a second theoretical qrayscale value equal to a preset qrayscale value of a sub-pixel image in an X-th row and the Y-th column in the first overdrive look-up table, and determine and output an actual qrayscale value of the sub-pixel image in the X-th row and the Y-th column from the first overdrive look-up table according to the position of the first theoretical grayscale value and the position of the second theoretical qrayscale value; and in response to determining that the pulse width modulation signal is at the low level:

retrieve the second overdrive look-up table from the memory; and for the image frame to be displayed:

determine a position of a first theoretical grayscale value equal to the preset grayscale value of the sub-pixel image in the (X−1)-th row and the Y-th column in the second overdrive look-up table, and a position of a second theoretical grayscale value equal to the preset grayscale value of the sub-pixel image in the X-th row and the Y-th column in the second overdrive look-up table, and determine the actual grayscale value of the sub-pixel image in the X-th row and the Y-th column from the second overdrive look-up table according to the position of the first theoretical qrayscale value and the position of the second theoretical grayscale value, wherein the image frame to be displayed includes J rows and Q columns of sub-pixel images, X is greater than or equal to 2, and is less than or equal to J, Y is greater than or equal to 1, and is less than or equal to Q, and X, Y, J and Q are all integers.

10. The timing controller according to claim 9, wherein the controller is further configured to retrieve the first overdrive look-up table and the second overdrive look-up table from a non-volatile memory, and store them in the memory.

11. The timing controller according to claim 9, wherein the controller is further configured to receive the pulse width modulation signal and a clock signal; and the controller is configured to, within each clock cycle of the clock signal, retrieve the first overdrive look-up table from the memory in response to determining that the pulse width modulation signal is at the high level, and retrieve the second overdrive look-up table from the memory in response to determining that the pulse width modulation signal is at the low level.

12. The timing controller according to claim 9, wherein in the first overdrive look-up table and the second overdrive look-up table:

grayscale values from a second column to an M-th column in the first row increase in sequence, and grayscale values from a second row to an N-th row in the first column increase in sequence;

a grayscale value in the second row and the first column is a minimum theoretical grayscale value, and actual grayscale values from the second column to the M-th column in the second row are all equal to the minimum theoretical grayscale value;

a grayscale value in the N-th row and the first column is a maximum theoretical grayscale value, and actual grayscale values from the second column to the M-th column in the N-th row are all equal to the maximum theoretical grayscale value; and for a third row to an (N−1)-th row, actual grayscale values from the second column to the M-th column in each row change in a decreasing trend.

13. The timing controller according to claim 9, wherein in the first overdrive look-up table and the second overdrive look-up table:

grayscale values from a second column to an M-th column in the first row increase in sequence, and grayscale values from a second row to an N-th row in the first column increase in sequence;

a grayscale value in the second row and the first column is greater than a minimum theoretical grayscale value, and a grayscale value in the N-th row and the first column is less than a maximum theoretical grayscale value; and for the second row to the N-th row, actual grayscale values from the second column to the M-th column in each row change in a decreasing trend.

14. A liquid crystal display apparatus, comprising:

a liquid crystal display panel including a plurality of data lines;

a backlight module, the backlight module including a backlight driving circuit and at least one light source electrically connected to the backlight driving circuit, the backlight driving circuit being configured to drive the at least one light source according to a pulse width modulation signal; and a drive system including:

the timing controller according to claim 9, the timing controller being connected to the backlight driving circuit; and at least one source driver connected to the timing controller and the plurality of data lines, the at least one source driver being configured to receive the actual grayscale value of the sub-pixel image in the X-th row and the Y-th column output by the timing controller, and provide a voltage signal to a corresponding data line according to the actual grayscale value.

15. The liquid crystal display apparatus according to claim 14, further comprising a non-volatile memory configured to store the at least one overdrive look-up table.

16. The liquid crystal display apparatus according to claim 15, further comprising a circuit board and a first flexible printed circuit board that is connected to the circuit board and the liquid crystal display panel, wherein the at least one source driver is disposed on the liquid crystal display panel, and the timing controller and the non-volatile memory are disposed on the circuit board.

17. The liquid crystal display apparatus according to claim 15, further comprising a circuit board and a second flexible printed circuit board, wherein one edge of the second flexible printed circuit board is bonded to the liquid crystal display panel, and another edge of the second flexible printed circuit board is connected to the circuit board; and the at least one source driver is disposed on the second flexible printed circuit board, and the timing controller and the non-volatile memory are disposed on the circuit board.

* * * * *